United States Patent [19]

Schaltegger

[11] Patent Number: 4,753,275

[45] Date of Patent: Jun. 28, 1988

[54] METHOD AND APPARATUS FOR HIGH SPEED CONTAINER PLACEMENT

[76] Inventor: Herbert E. Schaltegger, 10 Schaghticoke Trail, New Milford, Conn. 06776

[21] Appl. No.: 38,036

[22] Filed: Apr. 13, 1987

Related U.S. Application Data

[63] Continuation-in-part of Ser. No. 893,035, Aug. 1, 1986, Pat. No. 4,657,054, which is a continuation-in-part of Ser. No. 716,680, Mar. 27, 1985, Pat. No. 4,625,775.

[51] Int. Cl.[4] ..... B65B 1/04

[52] U.S. Cl. ..... 141/1; 141/167; 141/170; 74/393; 198/504; 198/474.1; 198/343

[58] Field of Search ..... 141/83, 98, 129–191, 141/1–12; 198/504, 505, 474.1, 475.1, 343; 74/393

[56] References Cited

U.S. PATENT DOCUMENTS

| | | | |
|---|---|---|---|
| 2,860,760 | 11/1958 | Yeo et al. | 198/24 |
| 2,931,276 | 4/1960 | Zerlin | 198/474.1 |
| 3,978,968 | 9/1976 | Rose et al. | 198/339 |
| 4,168,773 | 9/1979 | Thiel et al. | 198/479 |
| 4,275,807 | 6/1981 | Mohn et al. | 198/474.1 |
| 4,450,950 | 5/1984 | Foote, Jr. | 198/474.1 |
| 4,456,114 | 6/1984 | Mohn | 198/474.1 |
| 4,514,953 | 5/1985 | Patzwahl | 141/167 |

*Primary Examiner*—Houston S. Bell, Jr.
*Attorney, Agent, or Firm*—Edward D. C. Bartlett

[57] ABSTRACT

High speed container placement method and apparatus are provided, particularly for check weighing or for use in combination with high speed filling equipment for consumer products, such as instant coffee. A container separating device introduces groups of containers to a container placement and removal device for sequencing therethrough. The individual containers are transferred from an annular turntable to separate stationary work positions on a deck plate where they undergo a processing step. Following this processing step, the containers are removed from their respective stationary positions and returned to the annular turntable to be ultimately discharged from the container placement apparatus. The containers are placed at and removed from the work positions respectively by feeder and discharge guides which oscillate as they travel about the deck plate along an epicycloidal type path. There may be a plurality of feeder and discharge guides, these being arranged as two or more sets of single guides, or one or more sets of double guides diametrically opposite each other. The guides may have two relatively movable parts to enable the guides to open and close.

27 Claims, 17 Drawing Sheets

Position 1
Position 2
Position 3
Position 10
E1
E2
E3
E4
E5
E6
E7
E8
E9
E10
P1
P2
P3
P4
P5
P6
P7
P8
P9
P10
16
20
F1
F2
D1
D2
d1
d2
f1
f2

METHOD AND APPARATUS FOR HIGH SPEED CONTAINER PLACEMENT

CROSS REFERENCE TO RELATED APPLICATIONS

This is a continuation-in-part of application Ser. No. 893,035 filed Aug. 1, 1986 (to issue as U.S. Pat. No. 4,657,054) which is a continuation-in-part of application Ser. No. 716,680 filed Mar. 27, 1985 (issued as U.S. Pat. No. 4,625,775).

FIELD OF THE INVENTION

The present invention relates to methods and apparatus for high speed container placement. It is particularly applicable to filling and/or weighing operations to achieve net weight filling of product into and/or weighing of containers being processed at high line speeds.

BACKGROUND OF THE INVENTION

Various government regulations require that the average actual net weight of packaged or containerized consumer products, such as instant coffee, be equal to or above the labelled net weight of the products. To keep abreast of the demand for their products, manufacturers must utilize high speed filling machines which move the containers at constant speeds. Since only volumetric dispensing devices can be used to fill moving containers, and the labelled net weight must be close to the actual net weight even when the dispensed volume or the product density at at their lowest levels, manufacturers often overfill containers with considerable amounts of product as fluctuations in the density of the product and the dispensing volumes occur.

To eliminate such inaccuracies, it is desirable that the product be dispensed by weight into the container; however, accurate weighing requires a low rate of product flow which, in turn, requires long filling cycles. Ideally, to keep the length of filling time to a minimum, the containers may be first underfilled with the bulk of a product from a volumetric filling machine. Thereafter, these underfilled containers may be topped off with a small amount of product to bring the actual net weight to the labelled net weight in fairly short time cycle, e.g., under two seconds, utilizing low product flow in a machine dispensing by weight.

Since known weight dispensing devices cannot travel at high speeds and maintain their accuracy utilizing desirable low product flow rate, it has become necessary to perform the top-off dispensing operation from stationary dispensing devices. This permits an unimpeded flow of product into the stationary dispensing device as well as accurate weight control. With the containers travelling at a desired line speed, the containers must be decelerated to a stop underneath the dispensing device for the period of time necessary for the filling operation to be performed at a low rate of product flow, and then accelerated to restore them to their normal rate of line speed.

Conventional means employed to perform these deceleration/acceleration steps utilizes a reciprocating fork mechanism to decelerate the containers to rest under stationary dispensing devices, and then accelerate them back to line speed, the containers travelling in a straight line during the decelerating and accelerating. However, these mechanisms are incapable of operating in connection with high line speeds, even if they handle several containers simultaneously, since the mechanisms are large, bulky and require several time-consuming movements for proper positioning and removal of the containers in relation to the dispensing devices.

SUMMARY OF THE INVENTION

It is an object of the present invention to provide an improved method of high speed container placement, particularly in conjunction with filling and/or weighing of the containers.

It is also an object of the present invention to provide an improved container placement apparatus for use with high speed production lines.

It is a further object of the present invention to enable objects being processed at high line speeds to be placed at stationary receiving stations for adequate dwell periods of time.

A feature of the invention is transferring the containers between a conveyor, for example a turntable, and stationary container receiving stations along epicycloidal type curved paths. This has the advantage of enabling the containers being progressed at high line speeds to be accepted and to rest for processing and then the processed containers brought back to the high line speed, this being accomplished with smooth deceleration and acceleration, respectively, of the containers and with an adequate dwell time of the containers at the stationary receiving stations for processing.

Another feature of preferred embodiments of the invention is decelerating and accelerating, respectively, the containers to and from rest along curved paths with graduated deceleration and acceleration, respectively. The rate of both deceleration and acceleration preferably smoothly increasing from zero to a maximum value and then smoothly decreasing back to zero. This has the advantage of reducing shock to the containers during the transferring movements and enabling placement of the containers while being progressed at high line speeds.

Accordingly, therefore, there is provided by one aspect of the present invention a method of high speed placement of containers, comprising the steps of introducing a container into a circular path at a first speed, transporting the container along the circular path at this first speed, and transferring the container along an epicycloidal path to a stationary rest position. The container is maintained in the rest position for a rest period, processed during the rest period, and then transferred along the the epicycloidal path from the rest position to the circular path. Then the container is moved along the circular path at the first speed, and removed from the circular path at the first speed.

Advantageously, the processing step may comprise dispensing contents by weight into the container while stationary. However, the processing step may simply comprise check weighing.

Instead of containers, this method could be employed with other workpieces upon which it was desired to perform some operation, e.g. labelling, while they were at rest.

According to another aspect of the present invention there is provided a method of high speed placement of containers, comprising the steps of moving a container along a selected path at a production line speed, intercepting the container, and decelerating the intercepted container to rest, the intercepted container being moved along a first curved path during this decelerating step and being transferred thereby to a stationary container receiving station. The container is processed while at rest at the container receiving station, and then returned to the selected path, the processed container being accelerated along a second curved path during the returning step. Then the container is continued along the selected path at the production line speed.

The container may be partially pre-filled with contents before the intercepting step. The processing step may comprise dispensing by weight further contents to fill the container to a predetermined net weight. The partially pre-filling step may comprise dispensing the contents by volume, and the processing step may include weighing.

A portion of the deceleration and acceleration along intermediate portions of the curved paths is preferably at a higher rate than along beginning and end portions of these curved paths.

The first and second curved paths preferably comprise portions of a curve generated by a point on the circumference of a circle rolling on a base path. The base path is preferably a circle, but other base paths could be employed to provide portions of epicycloidal type curves for the first and second curved paths. An advantage of these types of curves is that they can be generated by rotary motion which facilitates and simplifies high speed operation.

According to yet another aspect of the invention, there is provided a high speed container placement apparatus, comprising a plurality of stationary container receiving stations disposed about a central axis, a conveyor movable around this axis, and guiding means for guiding and transferring containers between the conveyor and the container receiving stations. The guiding means comprises feeder and discharge guide members for moving the containers respectively to and from the receiving station. Means is provided for moving each of the guide members around the axis and for causing each of the guide members to define an epicycloidal type path, each guide member moving a respective container to or from the respective receiving station along a portion of an epicycloidal type path.

Means may be provided for moving the conveyor around the axis. Also, means is preferably provided for interrelating the conveyor moving means and the guide members moving means to cause the conveyor to move around the axis faster than the guide members move around the axis.

Preferably, means is provided for oscillating the guide members as the guide members move around the central axis. Each of the guide members is preferably pivotally mounted eccentrically on a rotatable gear. Advantageously, the gear may form part of gearing through which movement of the conveyor and movement of at least one of the guide members around the central axis are interrelated.

According to a preferred aspect of the present invention, two or more containers can be placed at stationary placement positions at the same time, and two or more processed containers removed from stationary placement positions at the same time. This is accomplished by having two or more feeder guides and two or more discharge guides. These guides may be all moved along portions of the same epicycloidal type path, or pairs of guides may move along different epicycloidal type paths.

There may be a plurality of sets of single feeder and discharge guides, each set of single guides comprising a feeder guide following behind a discharge guide. The discharge guide removes a container from a respective placement position and then the associated following feeder guide places another container at that placement position.

There may be one or more sets of double feeder and discharge guides, each set of double guides comprising two feeder guides disposed diametrically opposite each other and two discharge guides disposed diametrically opposite each other. The or each set of double guides discharges and replaces individual containers sequentially on one side of the apparatus and simultaneously does the same on the opposite side of the machine. With this arrangement, placement positions are used twice per complete cycle of the double set of guides around the apparatus.

With a set of double guides, the two feeder guides may be connected by a bar passing diametrically across the apparatus below the level of the placement positions. Similarly the two discharge guides may be connected by another bar. These bars may function to maintain the axes of oscillation of the respective guides on a circular path around the center of the apparatus; these bars may oscillate towards and away from each other as the guides move around the apparatus.

Preferably, the guides are mounted on and moved by gears meshing with and rolling around the outside of a stationary gear.

Preferably, the guides are of a two part construction, one part being movable relative to the other. The two parts of a guide may open up to receive or release a container, with the two parts closing around the container when the latter is being moved by the guide. The two parts of the guide may be operated by a cam associated with the mechanism for moving and oscillating that guide. Preferably one guide part is fixed and the other guide part moves relative thereto; when the two part guide is mounted on and moved by a gear as above, the cam may also be mounted on this gear.

With a plurality of sets of feeder and discharge guides, the time to complete one complete cycle of all the guides around the container placement apparatus can be increased while still handling containers being supplied at a high line speed, e.g. at a rate of 300 or more containers per minute. This reduces the linear speed of the containers while passing through the container placement apparatus. Also, by selecting various configurations of the disposition of the guides, e.g. multiple sets of double feeder and discharge guides, the dwell or rest time of containers at the placement positions can be increased with containers still being supplied to the apparatus at a high line speed. For example, with a guide configuration comprising three sets of double feeder and discharge guides, dwell times at placement positions can be arranged to be upwards of 2 seconds to even as long as 7 seconds or more, while the apparatus still receives containers at a high production line rate.

Other objects, features and advantages of the present invention will become more fully apparent from the following detailed description of the preferred embodiment, the appended claims and the accompanying drawings.

DETAILED DESCRIPTION OF THE PREFERRED EMBODIMENTS

In general, an embodiment of the invention and variants thereof will first be described with reference to FIGS. 1 to 35. Thereafter various other embodiments and variants of the invention will be described with reference to FIGS. 36 to 63.

Figure 1:
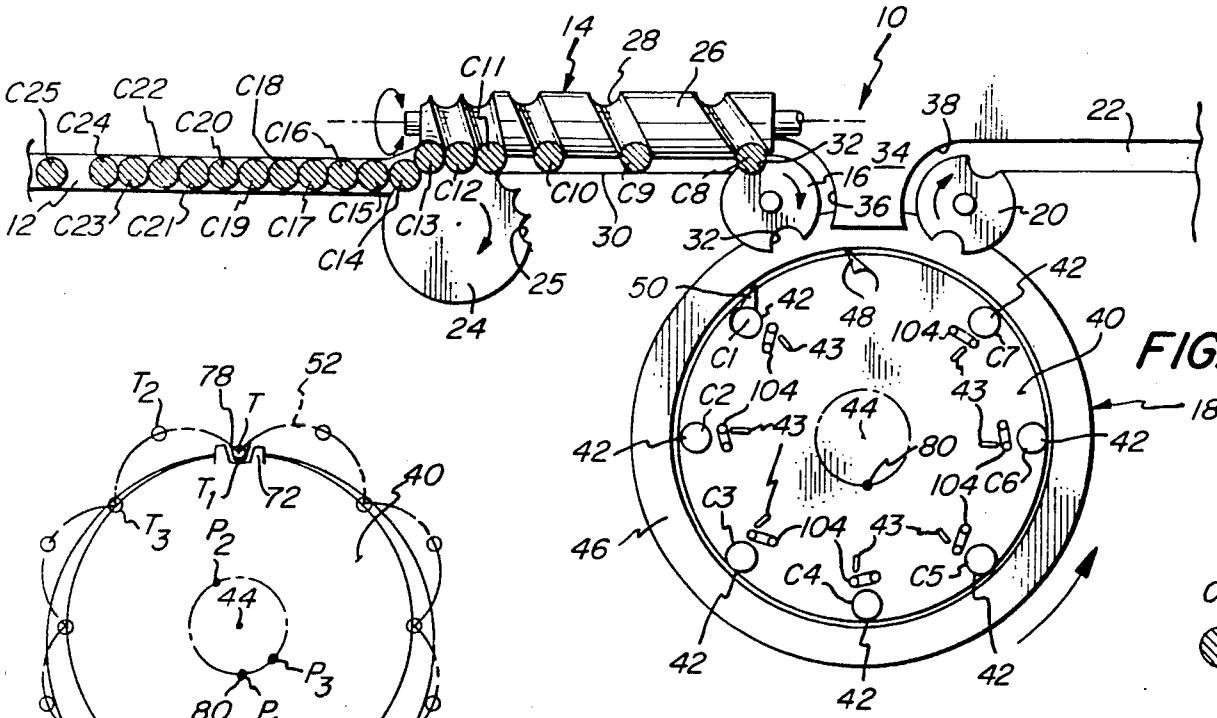
FIG. 1 is a schematic top elevational view of a container placement apparatus embodying the present invention.

Turning first to FIG. 1 of the drawings, therein illustrated is a high speed container placement apparatus embodying the present invention and generally indicated by the reference numeral 10. The apparatus 10 comprises a delivery conveyor 12, a container separating device generally indicated by the reference numeral 14, a rotatably driven supply star wheel 16, a container placement device generally indicated by the reference numeral 18, a rotatably driven exit gear wheel 20, and an exit conveyor 22.

The container apparatus 10 shown in FIG. 1 is in operating sequence with a plurality of containers C1 to C25 being sequenced therethrough. Throughout this and some of the subsequent embodiments, the containers will be designated by the letter C; however, designations for specific containers will also include a reference numeral, for example, container C1, etc. While being sequenced through the apparatus 10, the containers undergo processing or filling; containers which have not undergone processing are illustrated with cross hatched lines.

The delivery conveyor 12, which is of conventional belt or roller driven design, is generally flooded with containers awaiting processing through the container placement device 18. Adjacent the terminal end of the conveyor 12 is the container separating device 14, which permits release of seven containers in succession from conveyor 12 by means of a separating disk 24 rotatably driven in the clockwise direction and having seven cut-outs 25 along a portion of its outer periphery for engaging and separating the groups of seven containers. Each group is propelled by the separating disk 24 to a timing screw 26 rotatably driven to space or separate the containers from one another by a desired distance for purposes to be explained hereinafter.

The timing screw 26 is provided with a continuous helical groove 28 along the outer periphery thereof. The pitch of the groove 28 increases along the axial length of the timing screw 26 whereby rotation of the timing screw 26 will separate the individual members of the group of containers to achieve the desired spacing thereof. It is preferred that the timing screw 26 operate in conjunction with a retaining wall 30 which extends parallel to the longitudinal axis of the timing screw 26 and maintains the containers in the groove 28 therein.

Juxtaposed adjacent the righthand end portion of the timing screw 26 is the supply star wheel 16 rotatably driven in the clockwise direction and having a pair of diametrically opposed cut-outs 32 for receiving containers from the separating device 14 and transferring them to the container placement device 18. The star wheel 16 cooperates with a deflector 34 having opposed concave surfaces 36 and 38 to guide the containers in an arcuate path along the deflector 34. The operation of the star wheel 16 and the other portions of container separating device 14 is controlled by conventional means, such as appropriate gearing.

The container placement device 18 is provided with a stationary disk-shaped deck plate 40 having eight positions spaced concentrically around a central axis 44. Seven of these positions are provided with container receiving or weigh stations 42, each spaced a uniform distance from a central axis 44 and shown in FIG. 1 as having one of the containers C1 to C7 thereon. It should be noted that the deck plate position on deck plate 40 located between the star wheels 16 and 20 does not have a container receiving station 42 associated therewith. In the preferred embodiment, each of the receiving stations 42 has a dispensing device 43 (see FIGS. 1, 21 and 22) mounted thereabove for purposes to be explained further hereinafter.

Mounted concentrically about the deck plate 40 is an annular turntable 46 which is rotatable in the counterclockwise direction about the central axis 44. Mounted for oscillation over the deck plate 40 are feeder guide 48 and discharge guide 50. These guides 48, 50 oscillate as they travel about the deck plate 40 in an epicycloidal path 52 shown in FIG. 2 for purposes and in a manner to be explained further hereinafter.

The rotatably driven exit star wheel 20 is positioned adjacent the annular turntable 46 to intercept containers thereon and move them along arcuate surface 38 to the exit conveyor 22. The exit conveyor 22 is of conventional belt or roller driven design similar to the delivery conveyor 12, and moves the containers away from the container placement device 18 for further packaging or processing.

Figure 21:
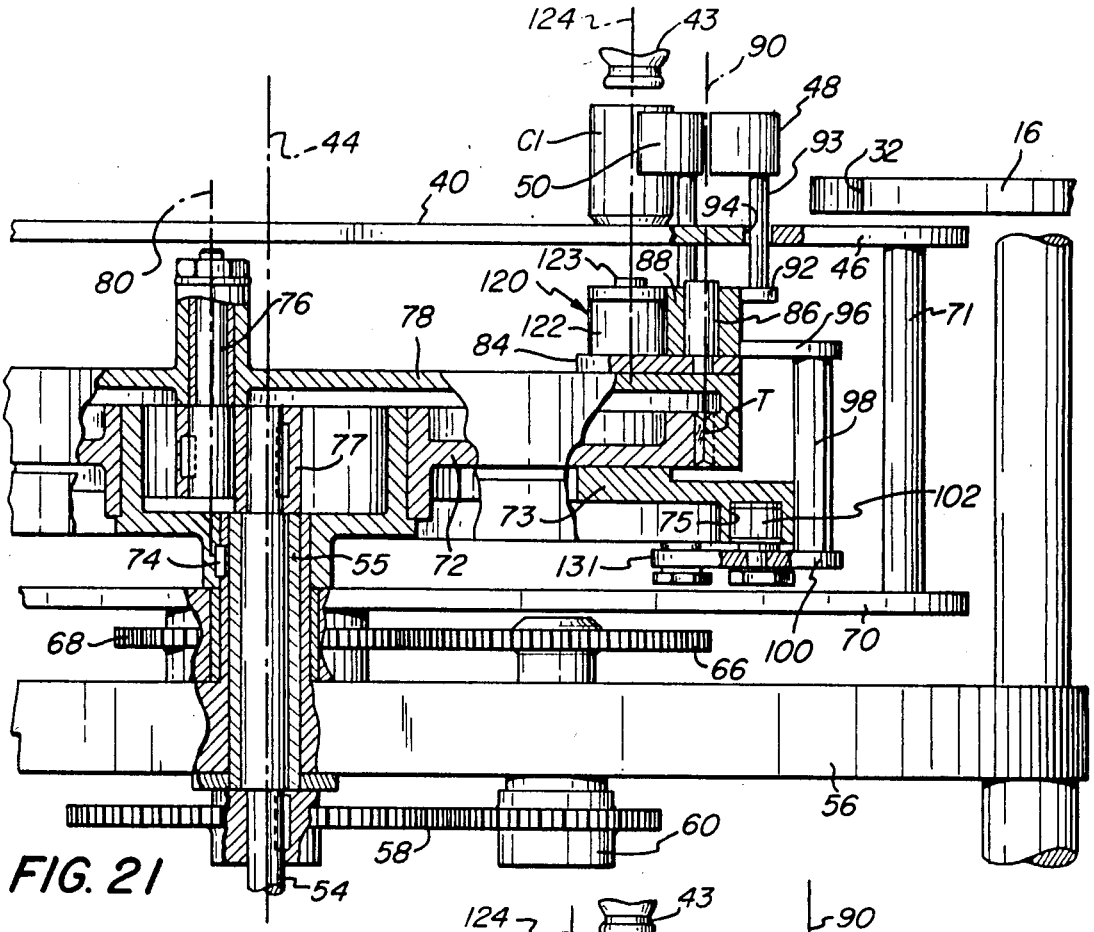
FIGS. 21 and 22 are fragmentary side elevational views of the apparatus of FIG. 1 showing the operating mechanism in its two extreme positions and having portions removed and broken away for purposes of illustration.
Figure 22:
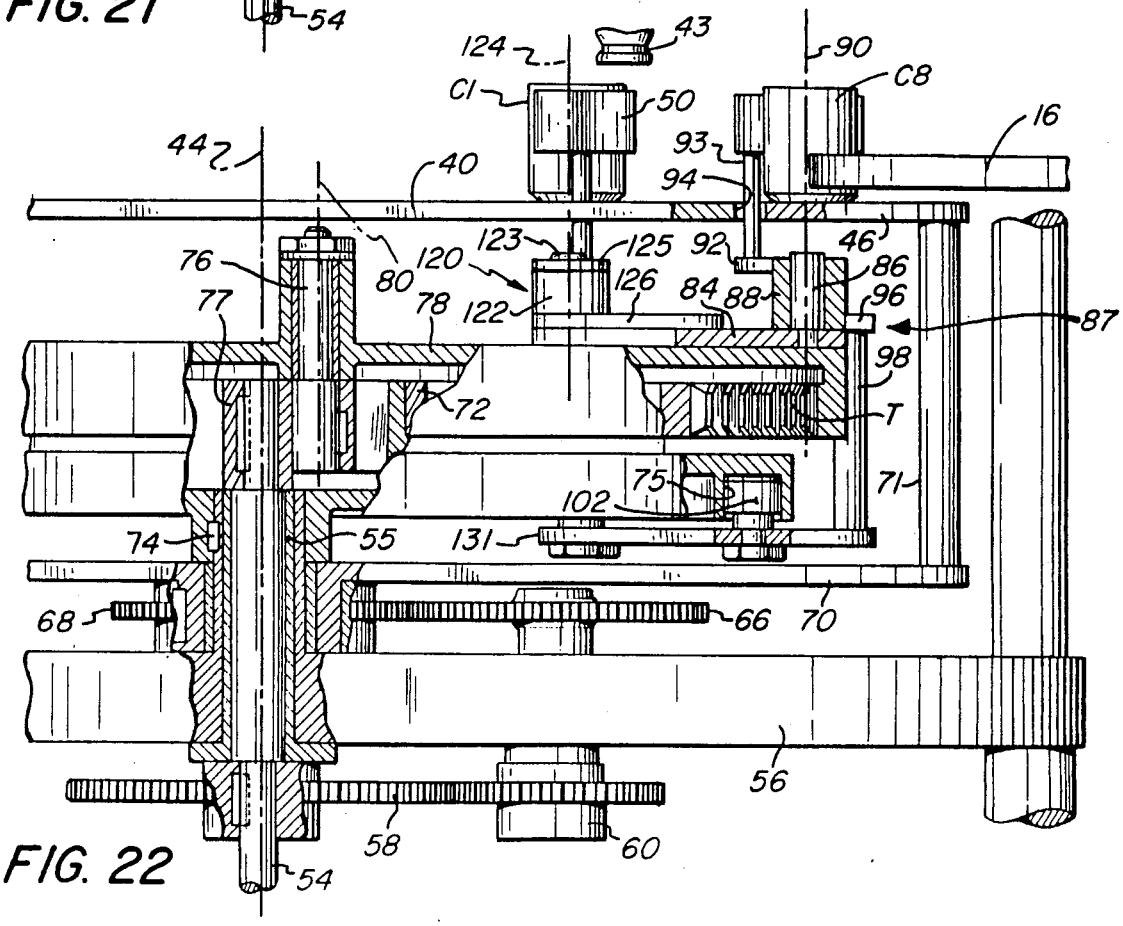

Turning now to FIGS. 21 and 22, the operating mechanism for oscillating and rotating the feeder and discharge guides can be more clearly understood. A main drive shaft 54 is journalled in a bearing 55 through a stationary machine frame 56 for rotation about the central axis 44 and is connected to a source of rotary power (not shown). Fixed to the drive shaft 54 is a gear 58 which meshes with a transfer gear 60. The gear 60 is operatively connected to an idler gear 66 on the upper side of the machine frame 56. The gear 66 meshes with a gear 68 secured to a drive plate 70. The drive plate 70 includes a multiplicity of column rods 71 (only one shown) extending upwardly at the outer periphery thereof. The column rods 71 support the annular turntable 46 at the upper ends thereof whereby rotation of the drive shaft 54 operates the gear train (gears 58, 60, 66 and 68) to rotate the drive plate 70 and ultimately the annular turntable 46 through the column rods 71 at a desired angular speed.

The main drive shaft 54, and the bearing 55 within which it is journalled, are disposed partially in and extend upwardly through central apertures within gear 68, plate 70 and a stationary gear 72. The stationary gear 72 is fixed to bearing 55 by key 74. The underside of the stationary gear 72 has an annular extension 73 which defines a circular cam track 75 outwardly from the outer edge of the stationary gear 72. The terminal end of the drive shaft 54 has a bracket 77 thereon including an eccentrically located shaft 76.

An internal gear 78 is rotatably mounted on the shaft 76 for rotatable movement about shaft axis or center 80. The internal toothed portion of internal gear 78 is in meshing engagement with the stationary gear 72 (note tooth T in FIG. 21) so that any tooth on the internal gear 78 describes an epicycloidal path, such as path 52 depicted in FIG. 2, when the center axis 80 of the internal gear 78 is rotated around the central axis 44.

Figure 34:
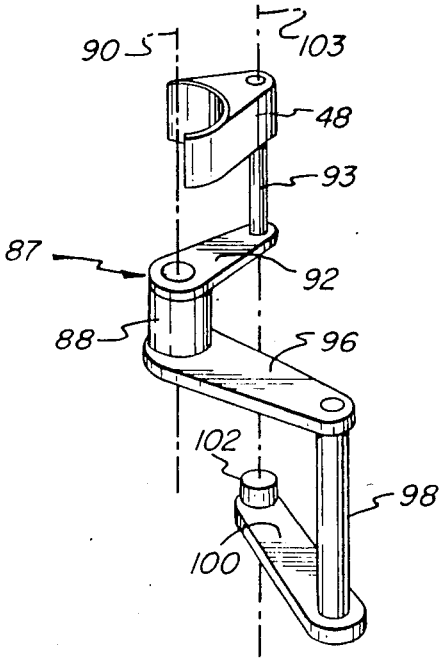
FIG. 34 is a perspective view of the feeder guide and its lever operating mechanism.

Rigidly mounted on the outer portion of the internal gear 78 is a plate 84 having a pin 86 extending upwardly therefrom and located on the pitch circle of the gear 78. Journalled on the pin 86 is a lever mechanism for the feeder guide 48 generally indicated by numeral 87 (FIG. 22) and including a bushing 88 rotatable about axis 90. As best seen in FIG. 34, the bushing 88 has an upper arm 92 extending outwardly therefrom with a support pin 93 mounted on the free end of the upper arm 92 and passing upwardly through an annular space 94 (see FIGS. 21 and 22) between the deck plate 40 and the annular turntable 46. The bushing 88 includes a lower arm 96 cantilevered outwardly therefrom at an acute angle relative to the upper arm 92. Extending downwardly from the outer end of the lower arm 96 is a rod 98 which is secured to one end of an extension arm 100. The other end of the extension arm 100 includes a cam roller or follower 102 captured in the circular cam track 75 to ride freely therein (see FIGS. 21 and 22). It should be noted that the cam roller 102 and the support pin 93 are always aligned on axis 103 while the feeder guide 48 and the pin 86 are axially aligned about axis 90. In this respect it should be noted that the feeder guide 48 extends transversely from the pin 93, the guide 48 having an arcuate concave shape at its distal end, as shown, for contact with a container to be placed; the axis 90 is coaxial with a central axis about which the concavely shaped distal end of the feeder guide 48 is formed. Although this concavely shaped distal end is shown as an arc of a circle, more precisely a segment of a cylinder, its shape may be varied depending upon the shape of the containers to be engaged and placed thereby. However, regardless of the precise shape of this concavely shaped distal end of guide 48, the central axis of the respective container when engaged and moved by the guide 48 is arranged to be coaxial with the axis 90.

Figure 35:
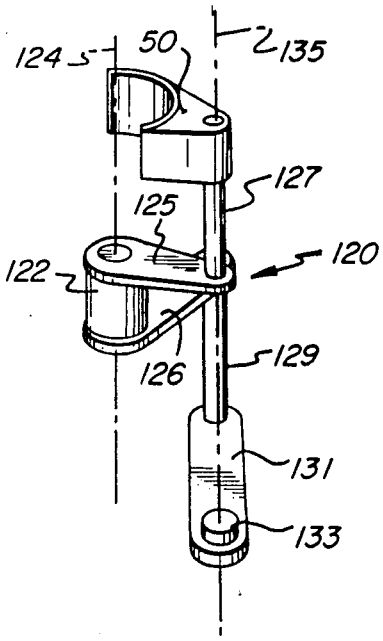
FIG. 35 is a perspective view of the discharge guide and its lever operating mechanism.

Referring to FIGS. 21, 22 and 35, the discharge guide 50 is operatively connected to a lever mechanism generally indicated by the numeral 120. The mechanism 120 is similar to the mechanism 87 for the feeder guide 48, but is mounted by its bushing 122 on a support pin 123 for rotation about axis 124. Arms 125 and 126 extend at an acute angle relative to one another from opposite ends of the bushing 122 and supportively mount pins 127 and 129, respectively, at the outer ends thereof. The pin 129 has an extension arm 131 on the lower end thereof which carries cam roller 133. The cam roller 133 is axially aligned with the pin 127 on axis 135 and is captured in the cam track 75. Again, the distal end of the discharge guide 50 is concavely shaped to conform to part of the shape of the container to be engaged thereby so that the central axis of the container is coaxial with the rotational axis 124.

Figures 29, 30, 31:
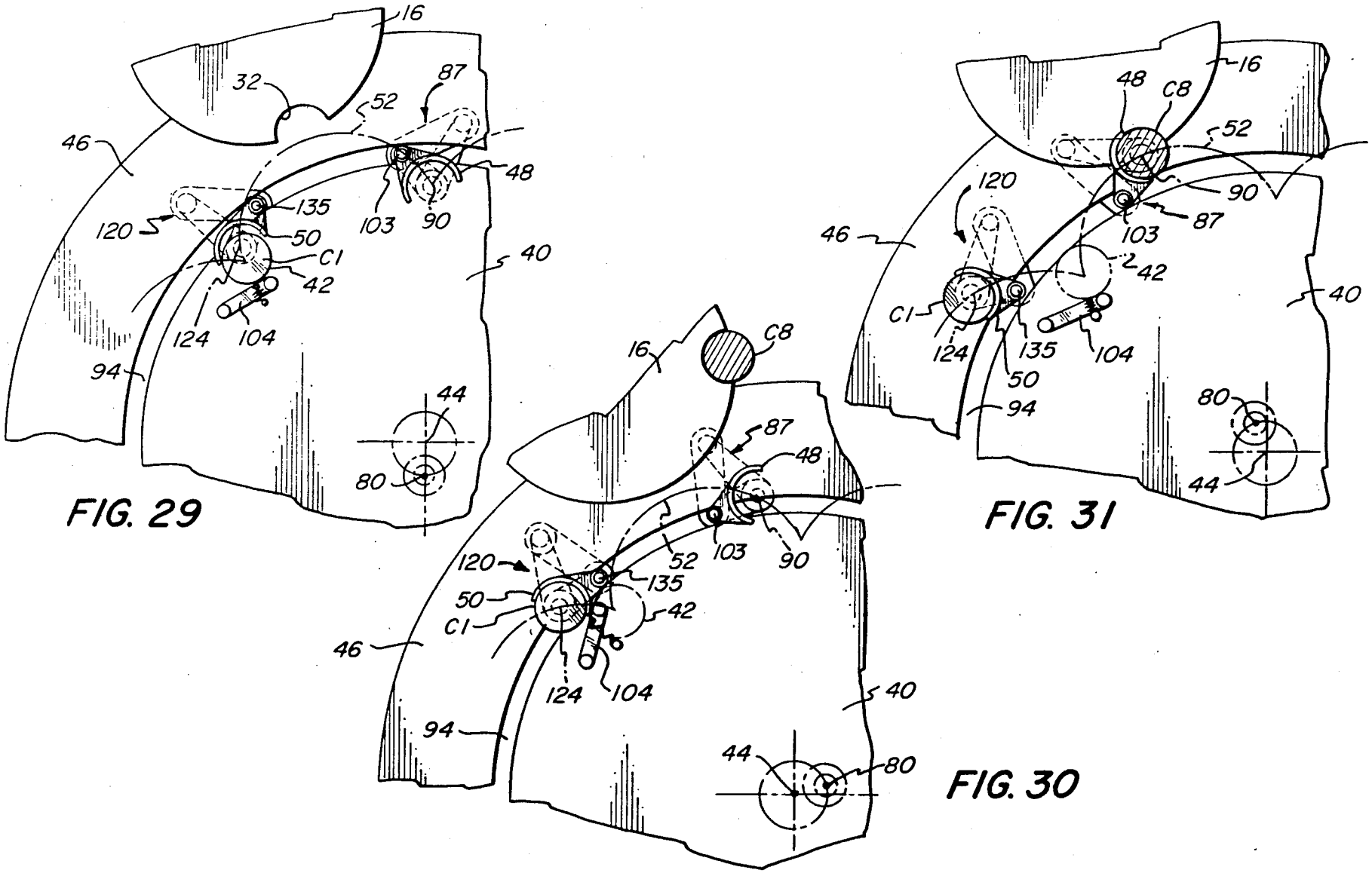
FIGS. 29 to 31 are schematic illustrations of the operation of a supply starwheel and the feeder and discharge guides.
Figure 32:
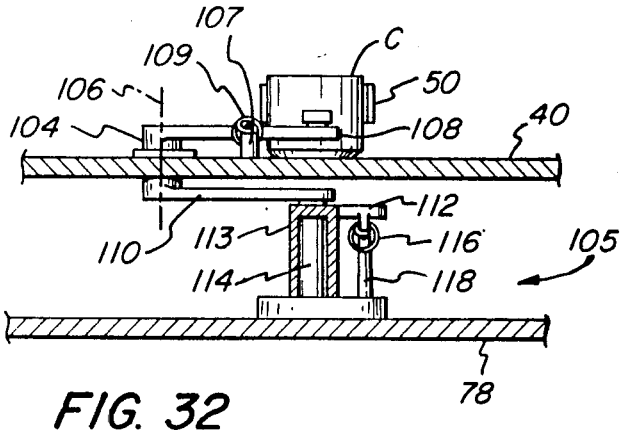
FIG. 32 is a fragmentary side elevational view of the apparatus of FIG. 1 with portions removed and broken away for clarity of illustration and showing the auxiliary discharge device cooperating with the discharge guide.

Referring now to FIGS. 29 to 31, in conjunction with FIGS. 34 and 35, axis 103 and thus pin 93 and cam roller 102 are on the leading or forward side of the axis 90 as the feeder guide moves in a counterclockwise direction in the epicycloidal path 52. The support pin 123 of the mechanism 120 is located forwardly of the axis 103 in the general direction of motion. The lever mechanism 120 is mounted in reverse of the mechanism 87 whereby the axis 135 trails the axis 124 as discharge guide 50 moves in the counterclockwise direction in the epicycloidal path 52.

Referring now to FIGS. 23 to 28 and 32, therein depicted is an auxiliary discharge device generally indicated by the numeral 105. The auxiliary discharge device 105 includes a plurality of container contact portions 104 located adjacent the receiving stations 42 (see FIG. 1). Each of the portions 104 is mounted for pivotal movement about an axis 106 in the stationary deck plate 40, and has an upper lever arm 108 biased into an inactive position against stop member 107 by a coil tension spring 109. A lower lever arm 110 is attached to the upper lever arm 108 at an acute angle thereto. As will be explained further hereinafter, the upper lever arm 108 of each of the container contact portions 104 contacts the associated container C while the lower lever arm 110 cooperates with an actuator 112 which is mounted on the internal gear 78 for movement therewith. The actuator 112 with bushing 113 is pivotally mounted on shaft 114 and biased by a coil tension spring 116 against the stop member 118 to the position shown in FIG. 23.

Figure 2:
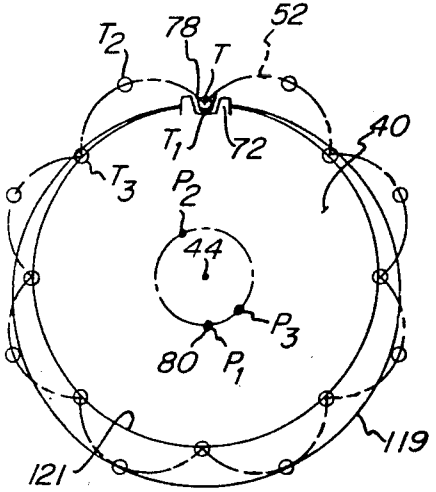
FIG. 2 is a diagrammatic illustration of the epicycloidal path described by a tooth T on an internal gear about a stationary gear.
Figure 3:
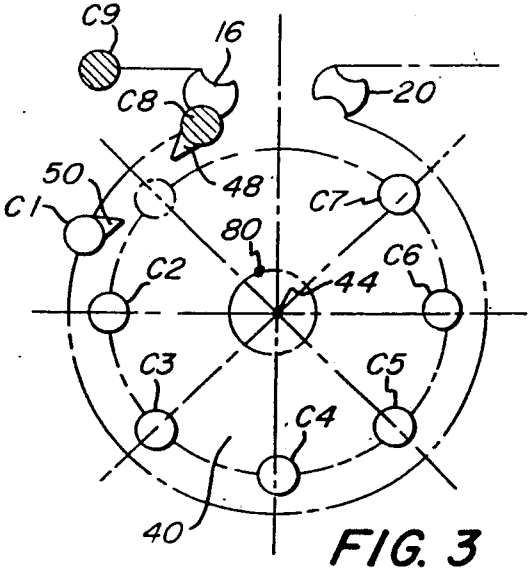
FIGS. 3 to 20 are schematic views illustrating the container placement apparatus and a method of the present invention performed thereby in operation with successive positions of a feeder guide and a discharge guide corresponding to successive turns of twenty-two and one-half degrees by the internal gear.
Figure 4:
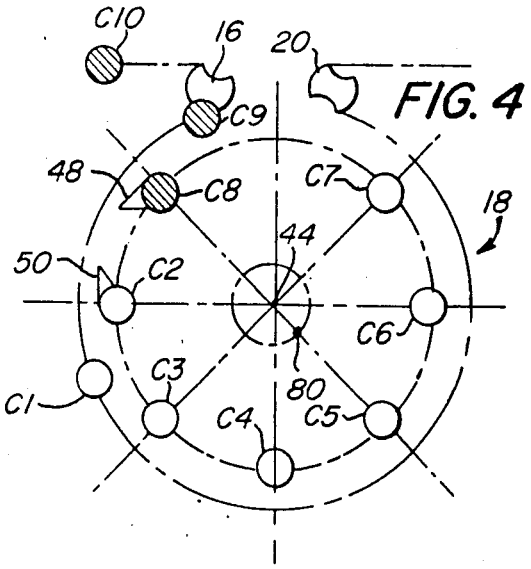
Figure 5:
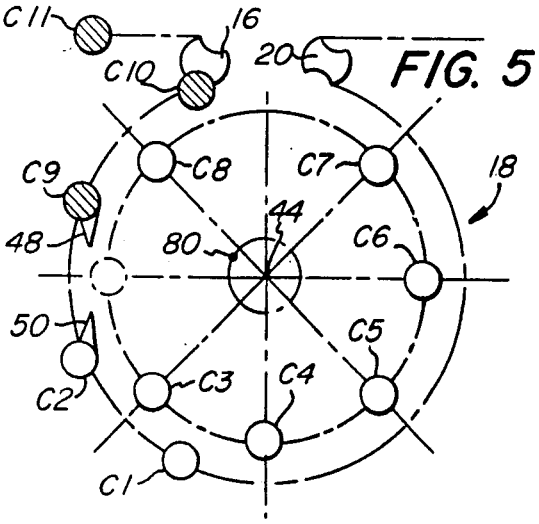
Figure 6:
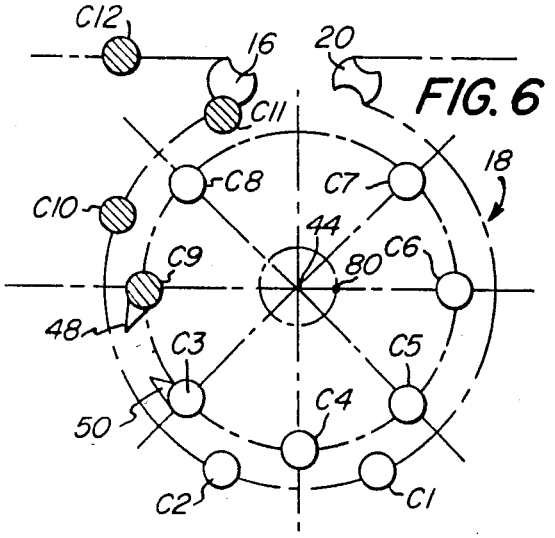
Figure 7:
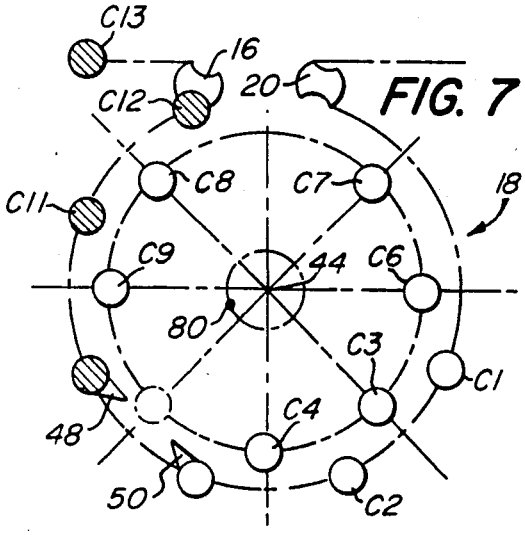
Figure 8:
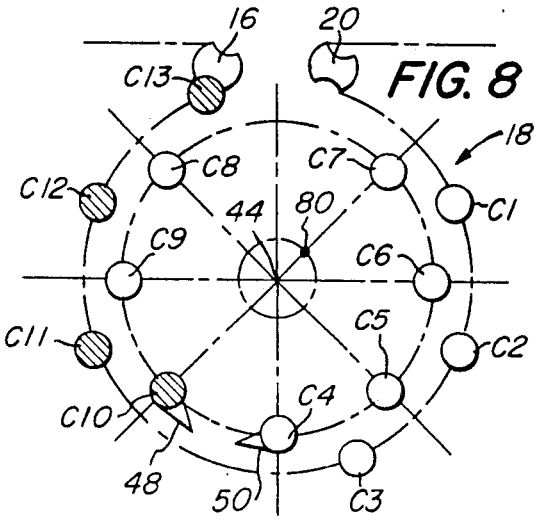
Figure 9:
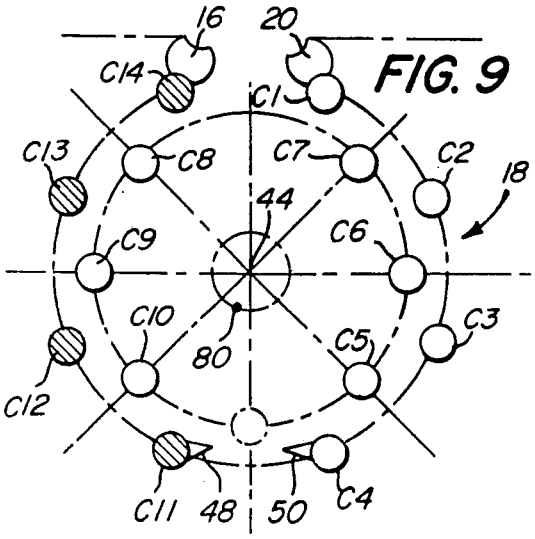
Figure 10:
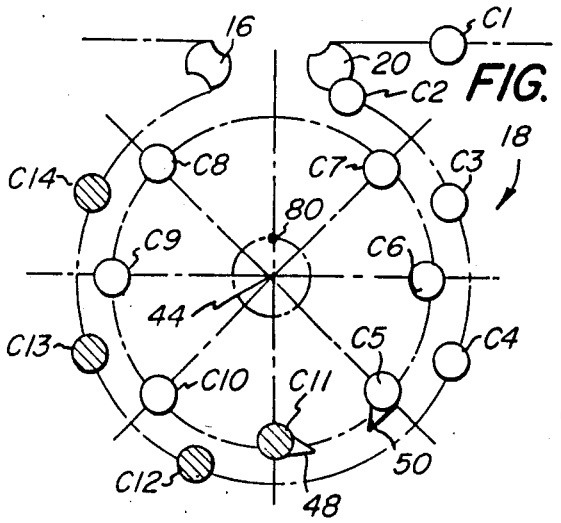
Figure 11:
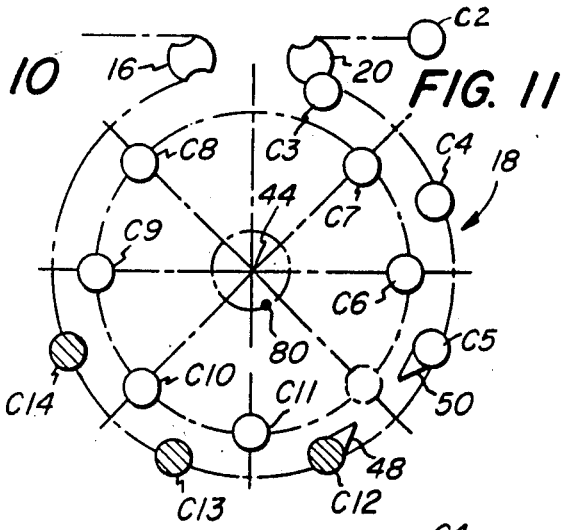
Figure 12:
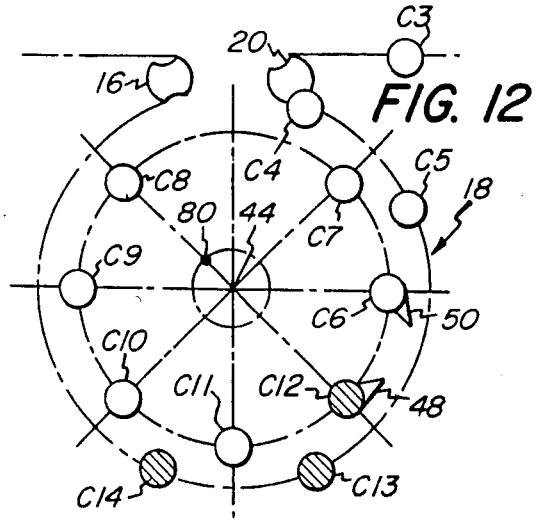
Figure 13:
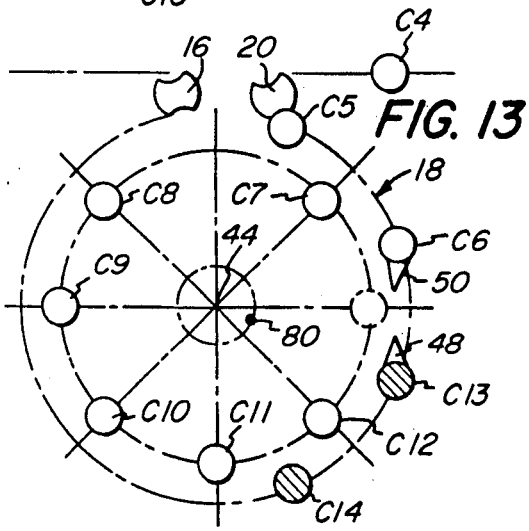
Figure 14:
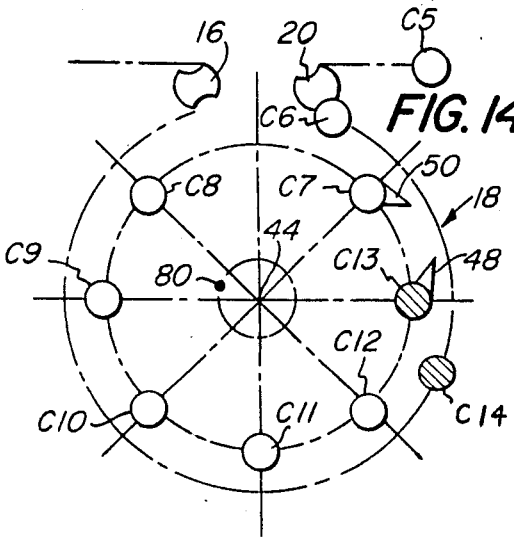
Figure 15:
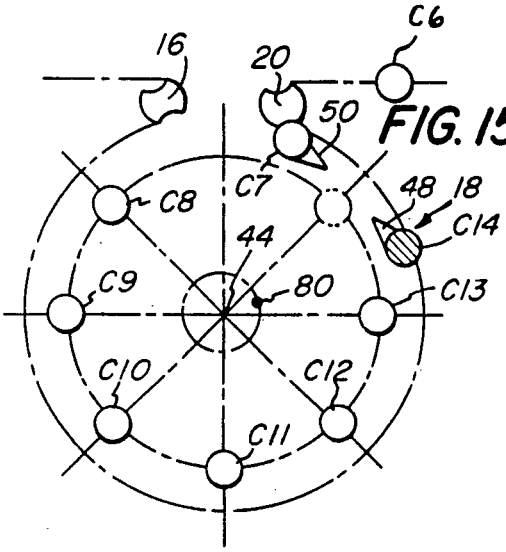
Figure 16:
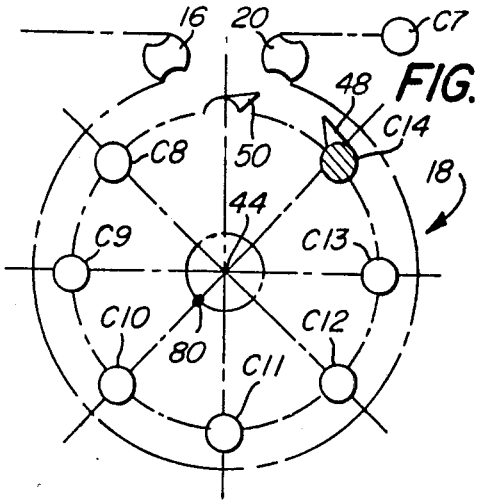
Figure 17:
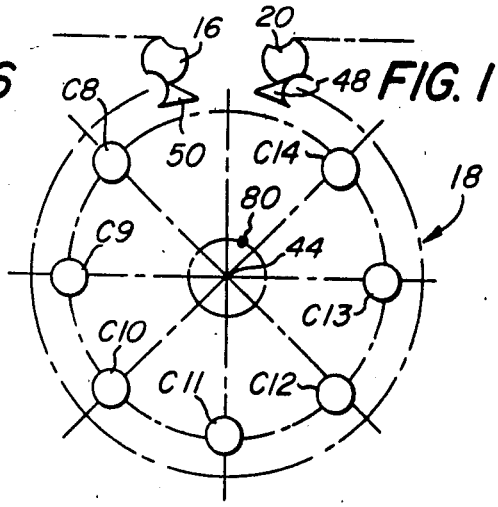
Figure 18:
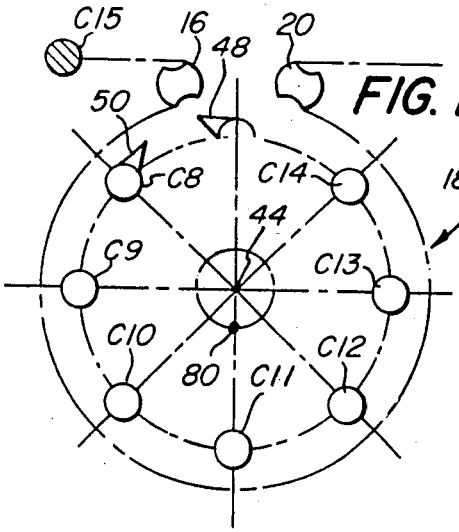
Figure 19:
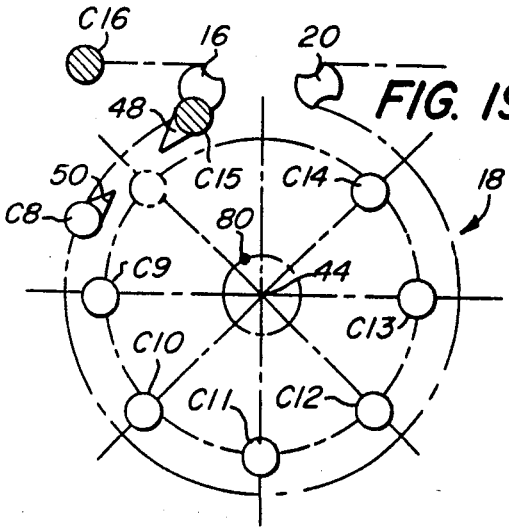
Figure 20:
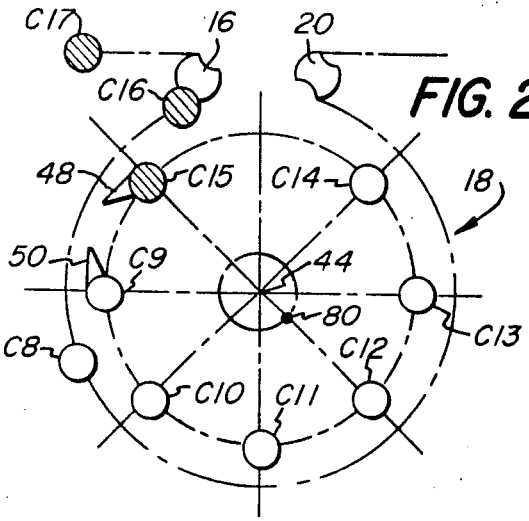

During normal operation of the machine starting from the machine position shown in FIGS. 1, 2 and 21, the main drive shaft 54 of the high speed placement apparatus 10 is rotated about central axis 44 thus swinging shaft 76 and internal gear 78 thereabout. Simultaneously, the gear train between the main drive shaft 54 and the drive plate 70 rotates the annular turntable 46 through column rods 71 at the desired angular speed. Meanwhile, the meshing relationship between the stationary gear 72 and internal gear 78 causes gear 78 to rotate about its axis 80. As illustrated in FIG. 2, the tooth T on the pitch circle 119 of internal gear 78 meshes with the teeth on the pitch circle 121 of stationary gear 72 at point T1 when the center 80 of gear 78 is located at point P1. The tooth T at point T1 is momentarily stationary. As the axis 80 continues to rotate around central axis 44 at a constant speed in the counterclockwise direction toward point P2, internal gear 78 is forced to rotate around its own axis 80 in the counterclockwise direction, and tooth T accelerates in a counterclockwise direction toward point T2, which is furthest away from the central axis 44, along the epicycloidal path 52 between T1 and T3. The speed of the tooth T is at its maximum speed at point T2. Continued counterclockwise rotation of the center 80 past points P2 and P1 and finally to point P3, decelerates the tooth T along the path 52 between T2 and T3 back into meshing contact with the stationary gear 72 at T3. Continued rotation of the main drive shaft 54 causes the tooth T to describe identical curves along the outer periphery of the stationary gear 72. The resulting path 52 is a perfect epicycloidal curve.

In the illustrated embodiment, the diameter of the stationary gear 72 is twelve inches with one hundred twenty teeth and the diameter of the internal gear 78 is thirteen and one-half inches with one hundred thirty-five teeth. Therefore, the distance between axes 44 and 80 is three quarters of an inch.

In normal operation, internal gear 78 rotates through an angle of forty degrees around its own axis 80 for each complete revolution of the axis 80 around axis 44. This is computed as follows:

135 (number of teeth on gear 78) − 120

(number of teeth on gear 72) = 15 (difference)

Difference/No. of teeth on gear 78 = 15/135 = 1/9 = 40/360

Therefore, axis 80 must make nine complete revolutions about axis 44 for internal gear 78 to make one complete revolution around gear 72.

The tooth T on internal gear 78 comes into contact with the stationary gear 72 once in every four hundred five degrees of the rotation of the axis 80 around axis 44. This is equal to one and one eighth turns around axis 44. Since a complete revolution of internal gear 78 requires nine turns of axis 80 around axis 44, the tooth T contacts with the stationary gear a total of eight times as shown in FIG. 2.

Referring again to FIGS. 29 to 31, the utilization of the epicycloidal motion of the internal gear 78 around the stationary gear 72 to oscillate the feeder guide 48 and discharge guide 50 can be more clearly understood. Referring first to the motion of the feeder guide 48, the axis 90 of pin 86 is located directly over the tooth T (see FIGS. 21 and 22) on the pitch circle of gear 78 and follows the epicycloidal path 52 illustrated in FIG. 2. As the pin 86 moves along the epicycloidal path 52, it forces the lever mechanism 87 to swing around the axis 90 since the cam roller 102 is captured in the cam track 75 and must follow the circular path defined thereby (see FIGS. 21 and 22). The angle over which the feeder guide 48 turns is determined by the arm length of upper arm 92 and in the embodiment herein depicted in ninety degrees so that the feeder guide 48 starts from a rest position adjacent the deck plate position between the star wheels 16 and 20 (FIG. 29) and swings outwardly (FIG. 30) in preparation to receive an empty container C8 from the star wheel 16 (FIG. 31) halfway between its travel to the receiving station 42.

Simultaneously with the movements performed by the feeder guide 48, the discharge guide 50, forwardly thereof, performs a similar movement. In the embodiment shown, the axis 124 of pin 123 of the discharge guide is positioned on the pitch circle of the internal gear 78 spaced fifteen teeth upstream from the tooth T. Since the lever mechanism 120 is mounted in reverse of lever mechanism 87, the discharge guide 50 swings around the axis 124 to enable the discharge guide to pick up a filled container from the stationary receiving station 42 (FIG. 29) and, with the assistance of the container contact portion 104 of the auxiliary discharge device 105, transfers the container radially outwardly (FIG. 30) onto the annular turntable 46 (FIG. 31) on which the container will continue to travel whilst the discharge guide 50 returns at a diminishing rate of speed to the next receiving station 42 to remove the associated filled container. It should be noted that the fifteen teeth spacing between the guides 48 and 50 causes the discharge guide 50 to lag slightly behind the feeder guide 48, e.g., the feeder guide 48 is in its stationary position in FIG. 29 while the discharge guide 50 is still approaching container C1 at weigh station 42.

Figure 23:
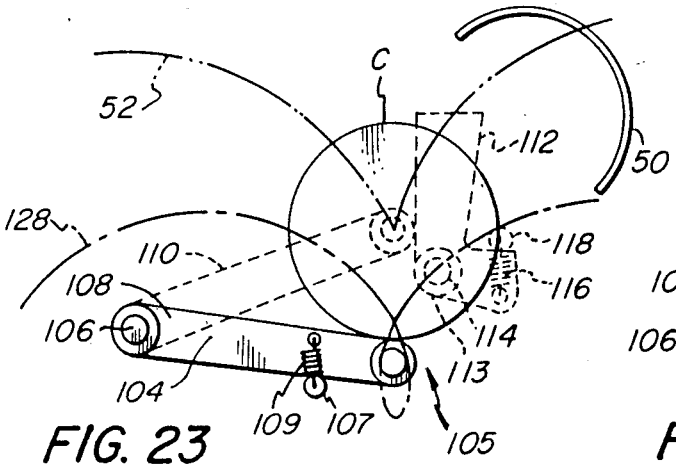
FIGS. 23 to 28 are schematic illustrations of the operation of an auxiliary discharge device in conjunction with the discharge guide.
Figure 24:
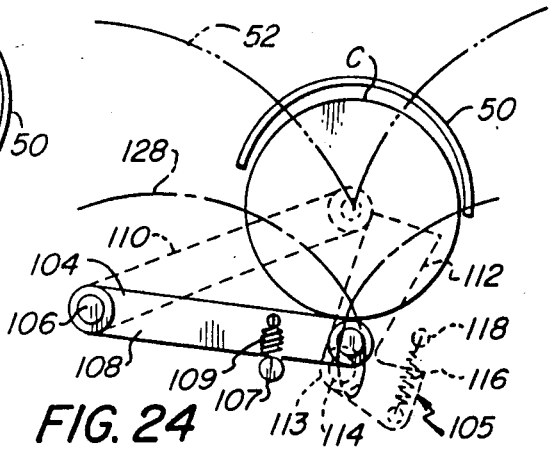
Figure 25:
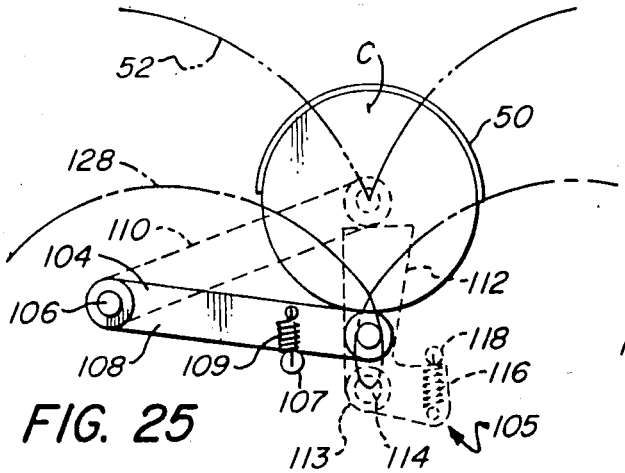
Figure 26:
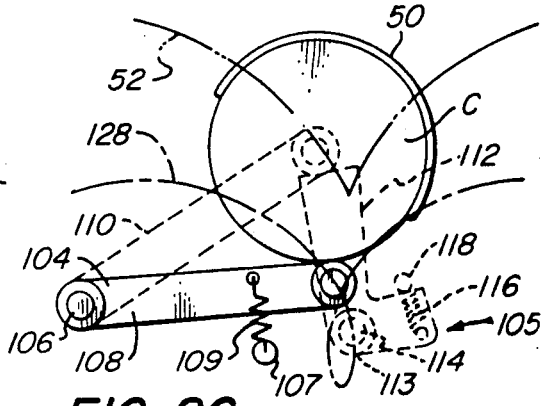
Figure 27:
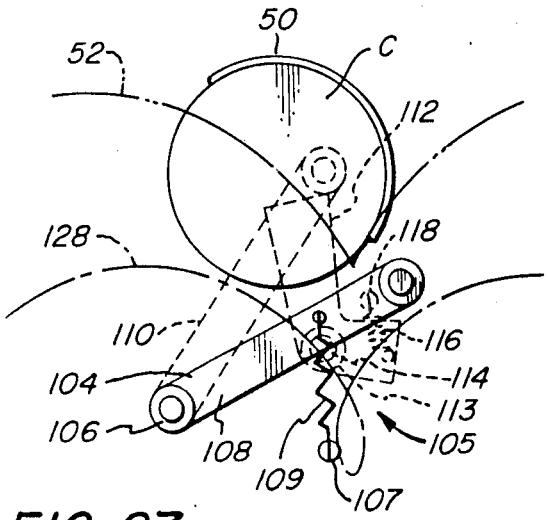
Figure 28:
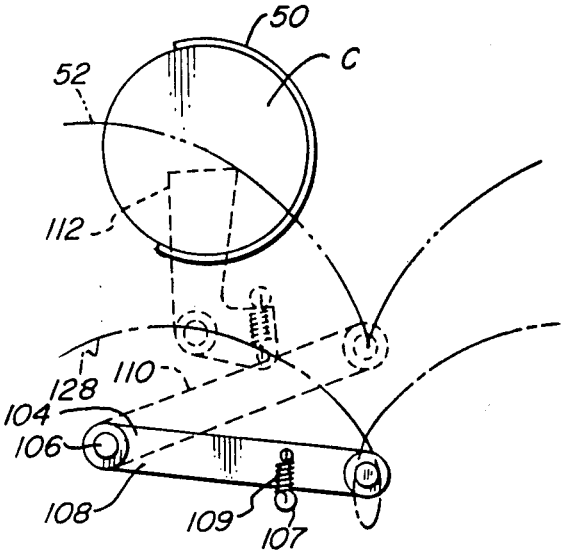

The operation of the auxiliary discharge device 105 is illustrated in FIGS. 23 to 28. Since points on the pitch circle of the gear 78 are describing epicycloidal curves, as its center axis 80 rotates around central axis 44, the pivot pin 114 spaced inwardly on the pitch circle on the gear 78 will traverse the curvilinear path indicated by numeral 128. In FIG. 23, the actuator 112 travelling with gear 78 initially engages the lower lever arm 110 of the container contact portion 104. Further movement of the gear 78 and the actuator 112 causes the actuator to pivot around the axis of the pivot pin 114 in the clockwise direction and against the bias of spring 116 (FIG. 24) until the actuator clears the lower arm 110 snapping back into the position shown in FIG. 25. The outer surface of the actuator 112 is then free to act upon the outer end of the lower lever arm 110 to enable the outer end of the upper lever arm 108 to cooperate with the discharge guide 50 and assist the transfer of the container C from the stationary receiving station 42 to the annular turntable 46 (FIGS. 26 and 30). As actuator 112 continues on the curvilinear path 128 as illustrated in FIGS. 27 and 28, the actuator 112 and the upper lever arm 108 disengage to allow the container contact portion 104 to return to original position under the influence of spring 109. It will be readily appreciated that the actuator 112 is mounted on the gear 78 adjacent discharge guide 50 and continues to follow the path 128. It performs its described function on each of the container contact portions 104 located adjacent each of the receiving stations 42 to cooperate with the discharge guide 50 in removing the containers therefrom.

Turning now to FIGS. 3 to 20 and again to FIG. 1, the high speed container placement apparatus 10 is diagrammatically illustrated in operation with the positions of the feeder guide 48 and discharge guide 50 shown in every turn of twenty-two and one-half degrees by gear 78 or, equivalently, a turn of two hundred two and one-half degrees of its axis 80 around axis 44.

As seen in FIG. 1, a group of seven containers C1 to C7 is in sequence in the placement device 18 with a respective one of the containers C1 to C7 located in each of the receiving stations 42. Meanwhile, a second group of seven containers C8 to C14 has been separated from the flooded delivery conveyor 12 by the clockwise rotation of the separating disk 24 utilizing seven cutouts 25. The rotation of the separating disk 24 is controlled by conventional means such as appropriate gearing to release groups of seven containers at the appropriate interval. The individual containers in the group C8 to C14 are spaced by the timing screw 26 and moved along arcuate surface 36 by the supply star wheel 16 onto the rotating annular turntable 46 where they can be intercepted by the feed guide 48.

As the containers are delivered to the receiving stations 42, an appropriate load cell (not shown) associated with each receiving station 42 measures the initial weight of the container and controls filling of the containers with a flow of product from the associated dispensing device 43 until the desired product weight has been reached. The load cells are conventional and commercially available and sold by Whitney Packaging-Processing Corporation located in Needham Heights, Mass. as their Model 0-8. The dispensing devices are commercially available from Mateer-Burt, a division of Berwind Corporation located in Wayne, Pa. and sold under the Trademark "Neotron Systems". For very accurate control, the dispensing of the product can be slowed to a very low rate as the desired net weight is reached.

As illustrated in FIGS. 3 to 20, the feeder guide 48 and discharge guide 50 act in concert by continuing to move around the periphery of the stationary deck plate 40 moving group C1 to C7 from the receiving stations 42 to the annular turntable 46 and replacing them with group C8 to C14. A third group of containers C15 to C21 (see FIG. 1) begins its approach to the container placement and removal device 18 in FIGS. 18 to 20.

As will be clearly apparent from studying the sequence of operations illustrated in FIGS. 3 through 20, the feeder guide 48 and the discharge guide 50 move around the central axis 44 together at the same rate, that is at the same r.p.m., with the discharge guide 50 always being a short distance downstream, that is ahead or forward, of the feeder guide 48. Also, it is clearly apparent that the annular turntable 46 rotates about the central axis 44 at a faster rate than the rate at which the guides 48, 50 move around the axis 44. This allows the unprocessed containers to successively advance towards the feeder guide 48 and then be intercepted and transferred by the feeder guide 48; it also allows for each processed container transferred back to the annular turntable by the discharge guide 50 to advance away from the discharge guide 50 leaving room for the next processed container to be transferred.

The speed of the annular turntable 46 and any containers thereon is at least equal to the speed of the feeder guide 48 at the moment the guide 48 intercepts a container on the turntable and to the speed of the discharge guide 50 at the moment the guide 50 releases a container on the turntable 46. Since the speed of each of the guides 48 and 50 at these moments is twice as fast as the average speed of gear 78, the annular turntable 46 has an angular speed at least twice as fast as the gear 78. With the illustrated arrangement, the turntable 46 rotates about the central axis 44 at a rate which is greater than twice the rate at which the guides 48, 50 are moved around the axis 44. The rate of rotation, i.e., r.p.m., of the turntable 46 may conveniently be in the range of 2.25 to 2.5 times the rate at which the guides 48, 50 are moved around the axis 44.

As will be appreciated, at the moment the feeder guide 48 fully intercepts a container to be placed, the container is then moving at twice the speed of the center of the rolling generating circle of the epicycloidal path, i.e. twice the rate at which the feeder guide 48 is being moved (or rotated) about the central axis 44. Then, at the instant the feeder guide 48 places this container at the respective receiving station 42, i.e. when at an inner cusp point of the epicycloidal path, the container and the feeder guide 48 are both at rest. In between, the container is smoothly decelerated at a changing rate of deceleration. The beginning and end portions of this deceleration have a lower rate, or value, than an intermediate portion of the deceleration. In other words, the rate of deceleration initially increases smoothly but rapidly from an initial rate, reaches a maximum rate of deceleration, and then the rate of deceleration decreases smoothly to a final rate. During this graduated deceleration the speed of the container smoothly decreases from twice the speed of the center of the rolling generating circle of the epicycloidal path to approximately 1.4 times the speed of the generating circle center at a point halfway to the rest position, and then over the second half of the epicycloidal path the container decreases from this 1.4 times speed to rest, i.e. to zero speed.

Similarly, the discharge guide 50 is momentarily at rest when it engages a stationary container at a respective receiving station 42. Then the discharge guide 50 and the container accelerate outwardly along the epicycloidal path until the discharge guide delivers the container to the turntable 46 at a speed which is twice that of the center of the rolling generating circle of the epicycloidal path. During this accelerating, the rate of accelerating rapidly increases from an initial rate, reaches a maximum rate of acceleration partway along the epicycloidal outward curved path, and then the rate of acceleration smoothly decreases to a final rate by the instant the discharge guide 50 releases the container. As the turntable 46 is moving at a greater speed than the maximum speed of the discharge guide at this point, the turntable effects a final accelerating of the processed container to the speed of the turntable. It will be noted that the processed container accelerates over the first half of this curved path from zero speed to a speed of approximately 1.4 times the speed of the center of the rolling generating circle of the epicycloidal path, and then over the second half of the curved epicycloidal path the container accelerates from this 1.4 times speed to twice the speed of the generating circle center.

Figure 59:
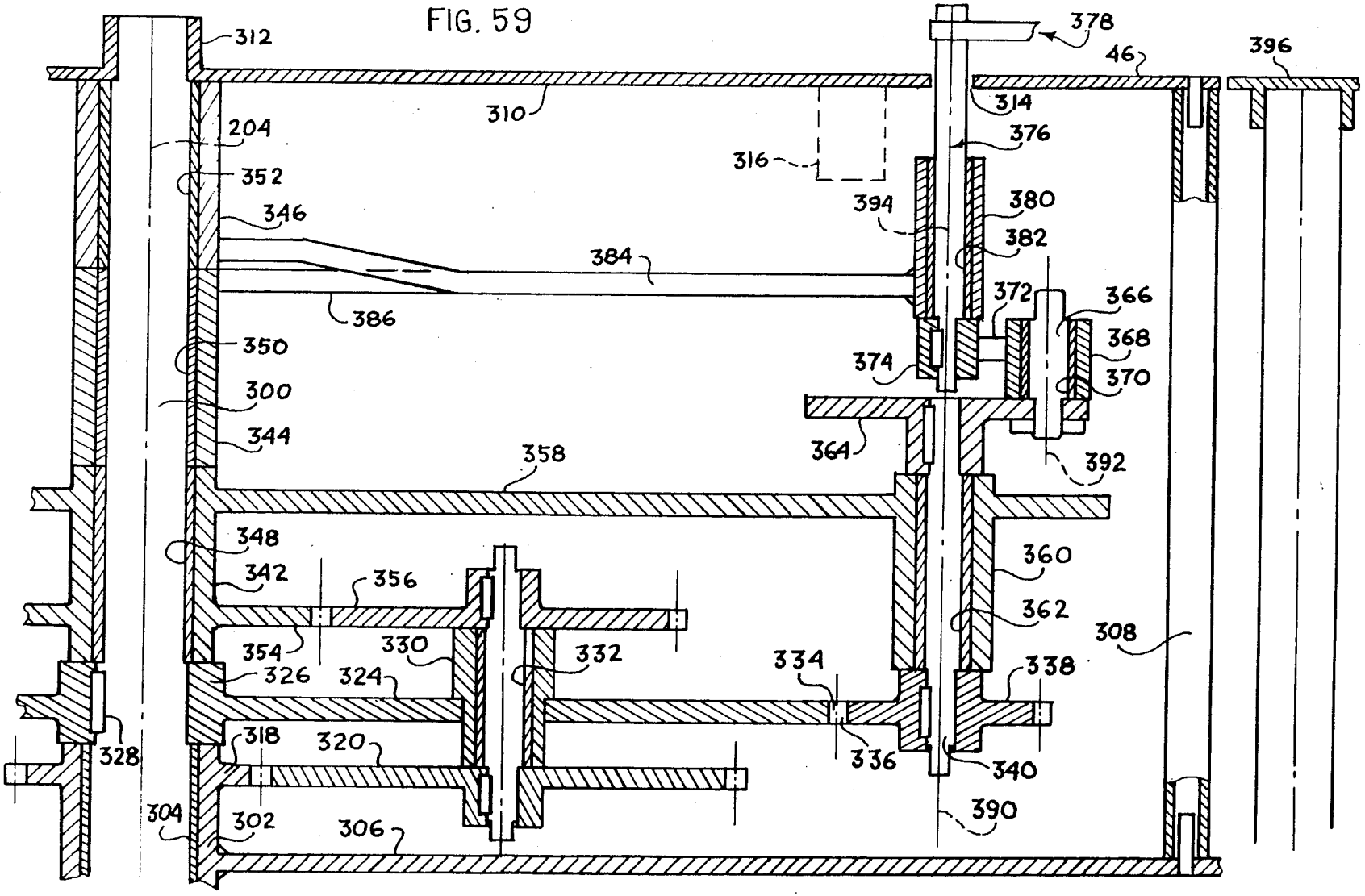
FIG. 59 is a diagrammatic vertical view mainly in section of part of a preferred container placement apparatus according to the invention and having a guide moving and operating mechanism modified from that shown in FIGS. 21 and 22.
Figure 60:
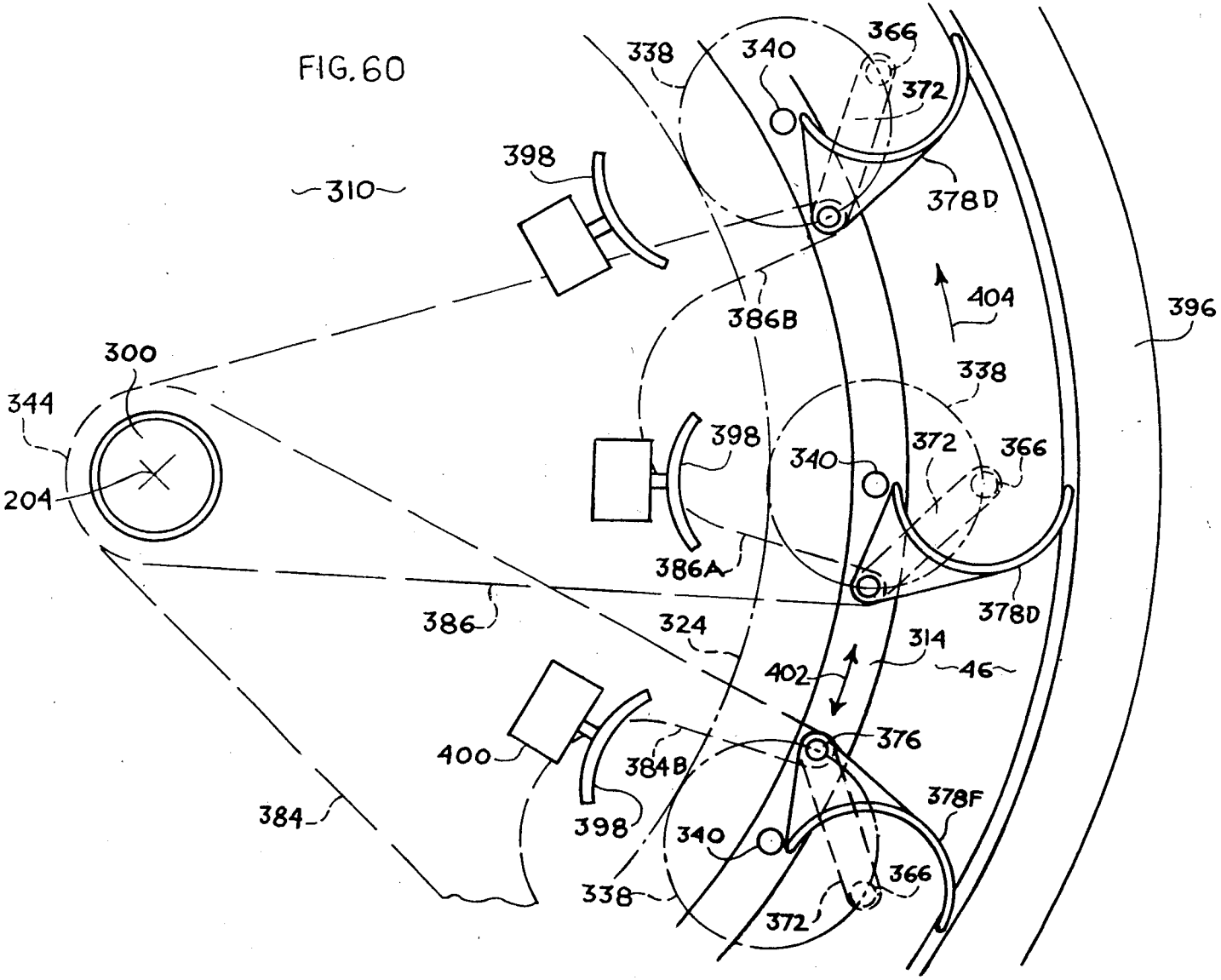
FIG. 60 is a diagrammatic fragmentary plan view of the apparatus of FIG. 59.

In a modified construction, which is preferred for higher line speeds, the internally toothed gear 78 may be replaced by a much smaller externally toothed gear. Such externally toothed gear would have a diameter equal to the amplitude of each curved portion of the epicycloidal path, and would mesh with and roll around the periphery of the stationary gear 72. Referring to FIG. 2, the amplitude of the curved portions of the epicycloidal path 52 is the radial height of the point $T_2$ outwardly of the base circle constituted by the pitch circle 121 of the teeth of the stationary gear 72. This smaller externally toothed gear, on which would be eccentrically mounted the discharge guide mechanism 120, would comprise the generating circle of the epicycloidal path 52 as this gear rolled around the stationary gear 72. A second similar externally toothed gear would carry the feeder guide mechanism 87 and roll in mesh around the stationary gear 72 behind the discharge guide gear. The center of the rolling generating circle of the epicycloidal path, as referred to above, would be the center of the respective one of these smaller externally toothed gears. Such an arrangement is illustrated in FIGS. 59 and 60, and will be further described later.

As illustrated in FIGS. 9 to 15, the exit star wheel 20 is timed to intercept the processed or filled containers, as they move with the turntable 46, and swing them along arcuate surface 38 onto exit conveyor 22 for further processing and/or packaging.

With seven positions used for receiving stations 42 in the normally eight position container placement and removal device 18, and with the guides 48 and 50 on gear 78 separated by an angle of 45°, a container in any of the seven positions is replaced after the gear 78 makes one revolution around its axis 80 of exactly three hundred sixty degrees. Since the axis 80 rotates nine times around axis 44 to replace a container in the same position, the replacement period of a container is, in this example, one ninth of one revolution of gear 78 and the rest period thereof is eight ninths of the time for one revolution.

With an assumed line of speed of two hundred containers per minute, gear 78 has to rotate 200/7=28.6 times per minute. Center 80 rotates nine times faster, that is at 257 RPM. The time required for one rotation is 60/257=0.233 seconds providing 1.86 seconds for each such rest period.

The relationship between the number of positions used on a unit 18, compared with the desired line speed, the resulting rest periods, etc. are as follows:

| | |
|---|---|
| Number of positions on unit | $P$ |
| Number of positions used as receiving stations | $P - 1$ |
| Line speed (containers per minute) | $LS$ |
| Gear ratio = gear 78/gear 72 = | $\frac{P+1}{P}$ |
| RPM of gear 78 = RPM G78 = | $\frac{LS}{P-1}$ |
| Time cycle for one revolution of gear 78 = 60/RPM G78 | $\frac{(P-1)60}{LS}$ |
| Time cycle for one revoltuion of axis 80 around axis 44 = | $\frac{60}{\text{RPM G78} \times (P+1)}$ |
| Time cycle for one revolution of axis 80 around axis 44 = | $\frac{60 \times (P-1)}{LS \times (P+1)}$ |
| Rest period = number of positions on unit $X$ time cycle for one revolution of gear 78 around gear 72 = | $\frac{P \times 60(P-1)}{LS(P+1)}$ |

The following charts list the rest period of containers with various sizes of units, based on different line speeds. As can be seen, relatively long rest periods can be obtained even on small units which operate at high line speeds. This will allow the time required for accurate dispensing of a product.

In the following charts, the letters at the top of the columns have the following meanings:

(a) Line speed, containers per minute
(b) RPM of gear 78
(c) Time cycle of gear 78 in seconds
(d) RPM of axis 80 around axis 44
(e) Time cycle of axis 80 around axis 44 in seconds
(f) Rest period in seconds With 8 positions on the unit there are 7 processing stations and the gear ratio of gear 78 to gear 72 is 9/8, and the following chart applies:

| (a) | (b) | (c) | (d) | (e) | (f) |
|---|---|---|---|---|---|
| 100 | 14.3 | 4.2 | 128.6 | 0.466 | |
| 3.73 | | | | | |
| 200 | 28.6 | 2.1 | 257.1 | 0.233 | 1.86 |
| 300 | 42.8 | 1.4 | 385.7 | 0.155 | 1.24 |
| 400 | 57.1 | 1.05 | 514.3 | 0.117 | 0.94 |
| 500 | 71.4 | 0.85 | 642.8 | 0.093 | 0.74 |
| 600 | 85.7 | 0.70 | 771.4 | 0.077 | 0.62 |

With 12 positions on the unit, 11 being processing stations, and the gear ratio of 78 to gear 72 being 13/12, the following chart applies:

| (a) | (b) | (c) | (d) | (e) | (f) |
|---|---|---|---|---|---|
| 100 | 9.1 | 6.6 | 118.2 | 0.507 | 6.08 |
| 200 | 18.2 | 3.3 | 236.4 | 0.254 | 3.04 |
| 300 | 27.2 | 2.2 | 354.5 | 0.169 | 2.03 |
| 400 | 36.4 | 1.6 | 472.7 | 0.127 | 1.52 |
| 500 | 45.5 | 1.3 | 591.0 | 0.101 | 1.22 |
| 600 | 54.5 | 1.1 | 709.0 | 0.085 | 1.02 |

With 18 positions on the unit, 17 being processing stations, and the gear ratio of gear 78 to gear 72 being 19/18, the following chart applies:

| (a) | (b) | (c) | (d) | (e) | (f) |
|---|---|---|---|---|---|
| 100 | 5.9 | 10.2 | 112 | 0.535 | 9.63 |
| 200 | 11.8 | 5.1 | 224 | 0.267 | 4.81 |
| 300 | 17.6 | 3.4 | 336 | 0.178 | 3.21 |
| 400 | 23.5 | 2.5 | 448 | 0.134 | 2.41 |
| 500 | 29.4 | 2.0 | 560 | 0.107 | 1.93 |
| 600 | 35.3 | 1.7 | 672 | 0.089 | 1.60 |

With 24 positions on the unit, 23 being processing stations, and the gear ratio of gear 78 to gear 72 being 25/24, the following chart applies:

| (a) | (b) | (c) | (d) | (e) | (f) |
|---|---|---|---|---|---|
| 100 | 4.3 | 14.0 | 107.5 | 0.56 | 13.4 |
| 200 | 8.7 | 7.0 | 215.0 | 0.28 | 6.7 |
| 300 | 13.0 | 4.6 | 322.5 | 0.18 | 4.5 |
| 400 | 17.4 | 3.5 | 430.0 | 0.44 | 3.3 |
| 500 | 21.7 | 2.8 | 537.5 | 0.11 | 2.7 |
| 600 | 26.0 | 2.3 | 645.0 | 0.09 | 2.2 |

The difference between the diameters of gears 72 and 78 is governed by the number of receiving stations or positions on the apparatus 10 and the diameter of the containers being processed. For example, an eight-position machine with a diameter for gear 72 of twenty-four inches and diameter for gear 78 of twenty-seven inches, can handle containers not larger than three inches in diameter, i.e., the difference in diameter between the gears. If it is necessary to handle containers of double the diameter, i.e. six inches in diameter, the diameters of gear 72 and 78, and the size of this entire machine will have to be doubled.

Another way to accommodate large-sized containers is to reduce the eight-position machine to four positions, without changing the diameter of the gear 72 but increasing that of gear 78 to thirty inches. However, such a machine will have a reduced capacity since it has only four positions. To overcome this lack of capacity the four-position machine can be transformed into an eight-position machine without changing the diameters of gears 72 and 78 by rotating gear 72 on an intermittent basis in a direction opposite to the direction of gear 78. Gear 72 would have to be stationary whenever the guides 48 and 50 are in contact with containers in their stationary position. However, gear 72 can move as soon as the guides 48 and 50 start to move. The speed would be generally proportional to the speeds of the guides 48 and 50 on gear 78. Therefore, the four-position machine will essentially be changed to an eight-position machine capable of handling the same large containers without increasing the overall size by providing eight forty-five degree intermittent, backward movements of gear 72 totalling to a full turn, during the time required to turn axis 80 ten times around axis 44 and gear 78 one full turn, during which its guides will come to a stop eight times. These intermittent backward motions of gear 72 can be accomplished by conventional means such as an intermittently driven servo motor.

To change the same machine into a twelve-position machine, gear 72 will have to make twelve intermittent background movements of thirty degrees each, totalling to a full turn, while gear 78 makes one revolution with twelve stops and axis 80 rotates fifteen times around axis 44.

Figure 33:
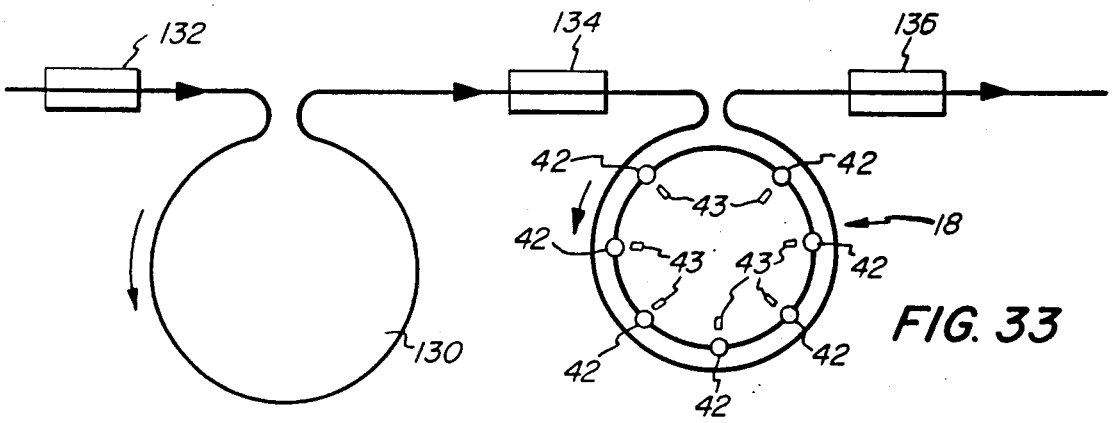
FIG. 33 is a schematic illustration of various arrangements of the apparatus of FIG. 1 to provide initial bulk filling of containers and subsequent high accuracy top-off filling of the containers.

To achieve the desired filling accuracy in the rest periods indicated on the preceding charts, it is sometimes desirable to bulk fill the containers prior to their introduction into the high speed container apparatus 10. FIG. 33 diagrammatically illustrates various arrangements to provide an initial bulk filling step to obtain maximum accuracy in product net weight. The filling device has a bulk filler generally indicated by numeral 130 and three positions 132, 134 and 136 for check weighers. Such weighers are commercially available from Whitney Packaging-Processing Corporation, Needham, Mass. and are sold under the trademark "Datachek". When the containers are non-uniform in weight, such as glass containers, the device can have a check weigher in position 132 and load cells at receiving stations 42. Each of the empty containers is weighed by the check weigher in position 132 and this information is relayed electronically to the load cell at receiving station 42 which will receive the same container and control the filling of the containers by weight. The empty containers are sent through the bulk filler 130 and filled by volume (to a little under weight) so that the containers merely have to be topped off with additional product at the receiving stations 42 by dispensing devices 43 to obtain the desired accurate net weight. This top-off operation is effective to reduce the filling time at receiving stations 42 and allows for very high speed operations.

Another arrangement is to replace the load cells of the previous example with a high speed check weigher at position 134. The partially filled containers coming from the bulk filler 130 are weighed by the check weigher in position 134 which relays the information to the respective dispensing devices to permit topping off of the partially filled containers.

Still another variation on this theme is the provision of another check weigher in position 136 to check the final net weight of the product as the containers leave the high speed placement device 18 of the previous example. The information generated by the check weigher in position 136 is used to automatically recalibrate the dispensing devices 43 on a continuous basis.

Turning now to FIGS. 36 to 41, these illustrate examples of various feeder and discharge guide configurations according to the invention. In each of these configurations, the transfer star wheels 16, 20 of FIG. 1 will be in approximately the same position as FIG. 1, although these star wheels have been omitted in FIGS. 36 to 41 for simplicity. It will also be understood that the container separating device 14 of FIG. 1 will be associated with each of the configurations of FIGS. 36 to 41 but with modification of the number and spacing of a sequence of containers as necessary.

Figure 36:
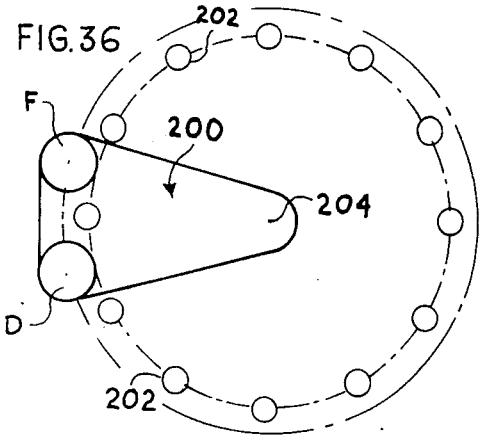
FIG. 36 is a schematic plan view illustrating a single set of single feeder and discharge guides in a twelve position container placement apparatus of the present invention, this being similar in concept to the arrangement shown in FIGS. 3 to 20.

FIG. 36 illustrates the guide configuration of FIGS. 1 through 20 in a schematic form except a twelve position machine is shown as opposed to an eight position machine in FIGS. 1 to 20. The feeder guide F, corresponding to feeder guide 48, is illustrated by a circle (as will be explained more fully later). The discharge guide D, corresponding to discharge guide 50, is similarly illustrated by a circle. The guides F, D are illustrated as forming part of a unit 200. Twelve placement positions 202 are shown, although only eleven of these may be operative and have load cells for receiving and weighing containers as will be explained later. The guides F, D move with the unit 200 around the central axis 204 sequentially removing processed containers and replacing them with unprocessed containers as previously described with reference to FIGS. 3 to 20. This is a single set of single feeder and discharge guides.

Figure 37:
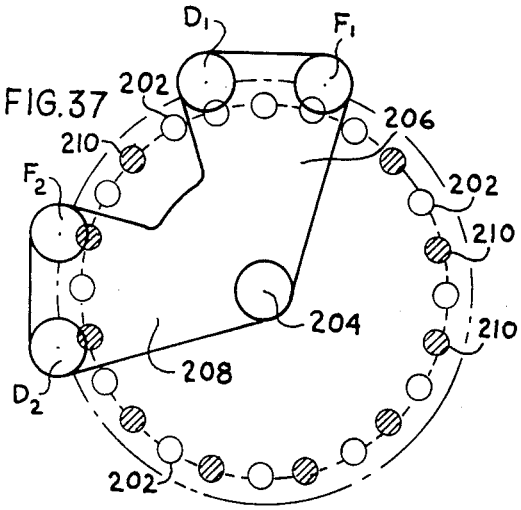
FIG. 37 is a schematic plan view illustrating two sets of single feeder and discharge guides in a twenty-four position container placement apparatus of the present invention.

FIG. 37 illustrates in a similar manner to FIG. 36 a modified machine having two sets of single feeder and discharge guides, one set being $F_1$, $D_1$, and the other set being $F_2$, $D_2$. Each set of single guides is associated with a respective unit 206, 208, these units 206, 208 moving together around the central axis 204. The guide set $F_1$, $D_1$ operates in relative to twelve placement positions 202 in the same manner as the guide set F, D in FIG. 36. However, the second guide set $F_2$, $D_2$, operates in relation to a further twelve alternate placement positions 210 shown crosshatched and disposed equally between the placement positions 202. In this configuration, the three uppermost placement positions in FIG. 37, i.e. one position 202 and two positions 210 would be inoperative with the remaining placement positions having load cells and/or filling units, etc. Thus, both the guides $F_1$, $D_1$ will move along the same epicycloidal path around the central axis 204, this being similar to the path 52 in FIG. 2 but having twelve internal cusps instead of eight as in FIG. 2; it is at these internal cusps that the containers are placed at rest at the placement positions. The second set of guides $F_2$, $D_2$ will move along a second epicycloidal path, identical to the path of the first set of guides $F_1$, $D_1$, but angularly displaced about the central axis 204 by an amount corresponding to half the circumference of the generating circle, so that the twelve internal cusps of the second path will be located midway between the internal cusps of the path of guides $F_1$, $D_1$. Both these epicycloidal paths have the same base circle and equal diameter generating circles. Thus, the first set of guides $F_1$, $D_1$ successively remove and replace containers at the placement positions 202, and the second set of guides $F_2$, $D_2$ successively remove and replace containers at the placement positions 210. The respective guides $F_1$, $F_2$ and $D_1$, $D_2$ may move out of phase with each other, or they may move in phase with each other as will be explained later. The machine of FIG. 37 will handle twenty-one containers per complete revolution about the axis 204 in comparison with eleven containers per revolution for the machine of FIG. 36.

Figure 38:
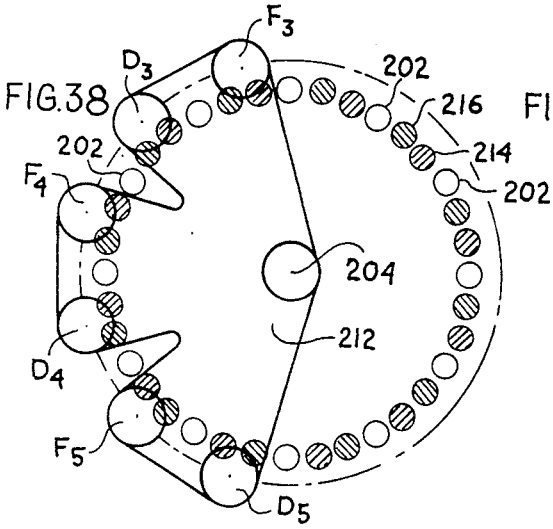
FIG. 38 is a similar view illustrating three sets of single feeder and discharge guides in a thirty-six position machine according to the invention.

FIG. 38 illustrates, in a similar manner to FIGS. 36 and 37, a further modified machine having three sets of single feeder and discharge guides $F_3$, $D_3$; $F_4$, $D_4$; and $F_5$, $D_5$, respectively, mounted on a common unit 212 rotatable about the central axis 204. This machine has three equispaced series of placement positions totalling thirty-six, only thirty-one of which may be operational. The first series of placement positions 202 are identical positioned to the placement positions 202 in FIGS. 36 and 37. The second series of placement positions 214 are disposed one third of the way between the positions 202. The third series of placement positions 216 are disposed two thirds of the way between the positions 202, i.e. each position 216 is equispaced between two adjacent positions 214 and 202. The single guide set $F_3$, $D_3$, places and removes containers at the first series of positions 202; the guide set $F_4$, $D_4$ places and removes containers at the second series of positions 214; and the guide set $F_5$, $D_5$ places and removes containers at the third series of positions 216. As the unit 212 rotates about the central axis 204, the three guide sets follow three similar but angularly displaced epicycloidal paths. A container is removed and replaced by another at each operative position 202, 214, 216 once per revolution about axis 204. Thus, thirty-one containers are handled and processed each complete revolution of the unit 212 about axis 204.

Figure 39:
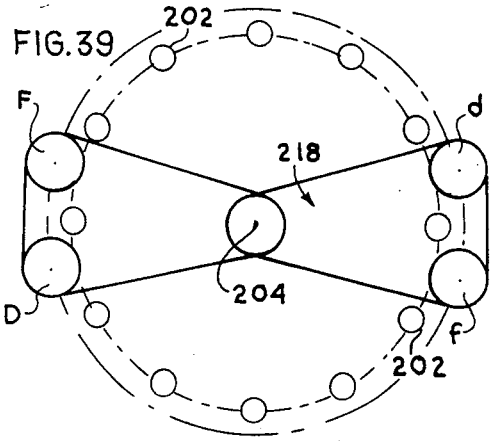
FIG. 39 is a similar view illustrating a single set of double feeder and discharge guides in a twelve position container placement apparatus of the invention.
Figure 40:
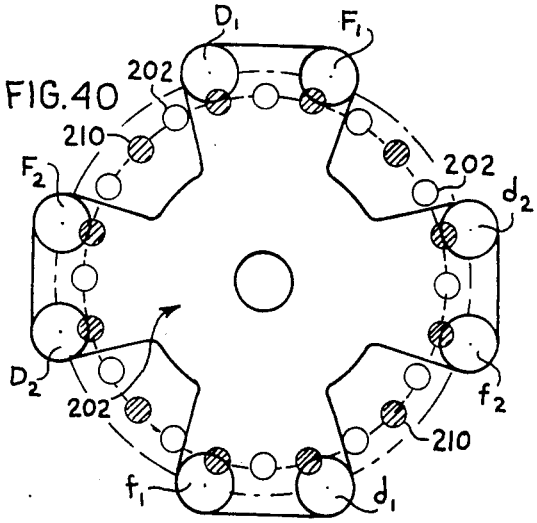
FIG. 40 is a similar view illustrating two sets of double feeder and discharge guides in a twenty-four position machine according to the invention.
Figure 41:
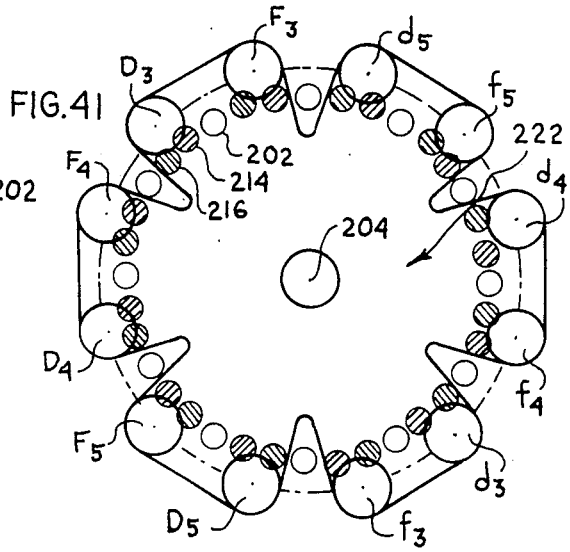
FIG. 41 is a similar view illustrating three sets of double feeder and discharge guides in a thirty-six position machine according to the invention.

FIGS. 39, 40 and 41 illustrate one, two and three sets, respectively, of double feeder and discharge guides in twelve, twenty-four, and thirty-six position machines, respectively.

The machine in FIG. 39 has the same twelve placement positions 202 as the machine of FIG. 36. Also, diametrically opposite one set of feeder and discharge guides F, D (with respect to the central axis 204), is another set of identical feeder and discharge guides f, d, all the guides being mounted on a unit 218 rotatable about axis 204. It should be noted that the two feeder guides F, f are diametrically opposite each other as are the two discharge guides D, d. In this arrangement, all the guides F, D, f, d will move along one and the same epicycloidal path as the unit rotates about the axis 204. However, two containers are replaced at each placement position 202 during each complete revolution of the unit 218. Containers sequentially discharged by the discharge guide D are not contacted or operated upon by the feeder guide f, and the same applies to discharge guide d and feeder guide F. It should be noted, therefore, that one revolution of the unit 218 in FIG. 39 will handle twice as many containers as one revolution of the unit 200 in FIG. 36; however, whereas in FIG. 36 a container is stationary at a placement position 202 for almost one revolution of the unit 200, in the configuration of FIG. 39 a container is stationary at a placement position 202 for just less than half a revolution of the unit 218. Thus, if the machine of FIG. 39 rotates at half the speed of the machine of FIG. 36, both machines will handle the same number of containers per minute and the dwell time of the containers at the placement positions will be approximately the same. This provides the advantage with the configuration of FIG. 39 of halving the speed of the machine for approximately the same throughput as the machine of FIG. 36.

The machine of FIG. 40 has the same twenty-four placement positions 202, 210 as the machine of FIG. 37. Also two sets of feeder and discharge guides $F_1$, $D_1$, and $F_2$, $D_2$ are the same and function the same as the two sets of single feeder and discharge guides $F_1$, $D_1$, and $F_2$, $D_2$ in FIG. 37. However, the machine of FIG. 40 has diametrically opposite the sets of guides $F_1$, $D_1$ and $F_2$, $D_2$ two further sets of single guides $f_1$, $d_1$, and $f_2$, $d_2$, respectively, with all the guides mounted on a unit 220 rotatable about the central axis 204. The guides $f_1$, $d_1$ will follow the same epicycloidal path as the guides $F_1$, $D_1$, and this set of double guides $F_1$, $D_1$, $f_1$, $d_1$ will operate on the placement positions 202. Whereas the guides $f_2$, $d_2$ will follow the epicycloidal path of the guides $F_2$, $D_2$ with the second set of double guides $F_2$, $D_2$, $f_2$, $d_2$ operating on the placement positions 210. A container will be replaced twice at each placement position 202, 210 during each complete revolution of the unit 220 about axis 204. It will be noticed that there are in fact four parts of associated feeder and discharge guides with these pairs being spaced 90 degrees apart about the axis 204. Containers operated upon by the guides of one set of double guides, e.g. $D_1$, $F_1$ and $d_1$, $f_1$, are arranged to move past the other set of double guides, e.g. $D_2$, $F_2$ and $d_2$, $f_2$, while these are at or adjacent internal cusps of their epicycloidal path. Thus, with the machines of FIGS. 37 and 40 operating on the same number of containers per revolution, the unit 220 of FIG. 40 will rotate at half the speed of the unit 208 of FIG. 37, yet the dwell time of the containers at their respective placement positions will be approximately the same. Further, comparing the machines of FIGS. 39 and 40, the unit 220 of FIG. 40 will rotate at approximately half the speed of the unit 218 of FIG. 39 with both machines handling the same number of containers per minute, but with the dwell time for containers at the placement positions of the machine of FIG. 40 being approximately double that of the machine of FIG. 39; on the other hand, if the machines of FIGS. 39 and 40 rotate at the same speed, the machine of FIG. 40 will handle containers at approximately twice the rate of the machine of FIG. 39 but with the containers of both machines having approximately the same dwell time at the placement positions.

In FIG. 41, the machine has the same thirty-six placement positions as the machine of FIG. 38. However, the three sets of single feeder and discharge guides of the machine of FIG. 38 have been supplemented with three further sets of respectively diametrically opposite guides to provide the machine of FIG. 41 with three sets of double feeder and discharge guides $D_3$, $d_3$, $F_3$, $f_3$; $D_4$, $d_4$, $F_4$, $f_4$; and $D_5$, $d_5$, $F_5$, $f_5$. The six pairs of associated feeder and discharge guides are equally spaced apart around the central axis 204. The six feeder guides are spaced at angular intervals of 60 degrees as are the six discharge guides. Also, the guides of each pair of associated feeder and discharge guides are spaced apart angularly about 30 degrees. The comparison between the machines of FIGS. 41 and 38 is similar to the comparison above between the machines of FIGS. 40 and 37. Also, the machine of FIG. 41 will rotate at approximately one third of the speed of the machine of FIG. 39 when both these machines handle the same number of containers per minute but then the dwell time of the machine of FIG. 41 will be approximately three times that of the FIG. 39 machine.

The above configurations can be further modified to provide machines with four or more sets of single feeder and discharge guides or four or more sets of double feeder and discharge guides. However, to avoid the possibility of containers being interfered with by a downstream guide which the container should pass outside, it is preferable to keep adjacent internal cusps of the angularly displaced separate epicycloidal paths (for different series of placement positions 202, 210, 214, 216 etc.) within an arcuate length about the axis 204 (i.e. along the common base circle of the epicycloidal paths, this being the pitch circle of the large stationary gear 72) which is not less than the number of separate epicycloidal paths multiplied by the diameter of the container size being handled. Thus the number of sets of guides and the diameter of the container size can affect the size of the pitch circle of the stationary gear and the diameter of the generating circle of circles rolling around this pitch circle.

To further help understand the sequencing the movement of containers through machines having a plurality of feeder and discharge guides, FIGS. 42 to 47 illustrate the operation of a machine having two sets of single feeder and discharge guides (modified from the machine of FIG. 37), and FIGS. 48 to 57 illustrate the operation of a machine having two sets of double feeder and discharge guides (modified from the machine of FIG. 40). In these sequences, it should be noted that fourteen placement position machines are illustrated (whereas FIGS. 37 and 40 show twenty-four position machines). Also, in FIGS. 42 to 57 containers being delivered to and removed from the container placement machine are shown, and the feeder and discharge guide are similarly shown as in FIGS. 3 to 20 and not by schematic circles as in FIGS. 36 to 41. It should further be noted that in the machine of FIGS. 42 to 47, the two feeder guides $F_1$, $F_2$ are grouped together adjacent each other, and the two discharge guides $D_1$, $D_2$ are grouped together and disposed just downstream of (i.e. ahead of) the pair of feeder guides $F_1$, $F_2$. The same series of containers C1, C2, C3, C4 etc. of FIG. 1 is employed.

Turning first to operation of the two sets of single guides of FIGS. 42 to 47.

Figure 42:
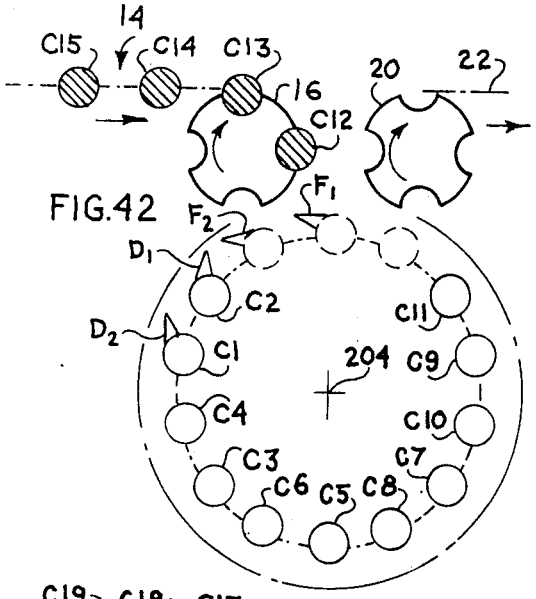
FIGS. 42 and 47 are schematic plan views illustrating a fourteen position container placement apparatus of the invention with two sets of single feeder and discharge guides in operation, these guides being shown in successive positions in sequentially placing and removing containers in pairs.
Figure 43:
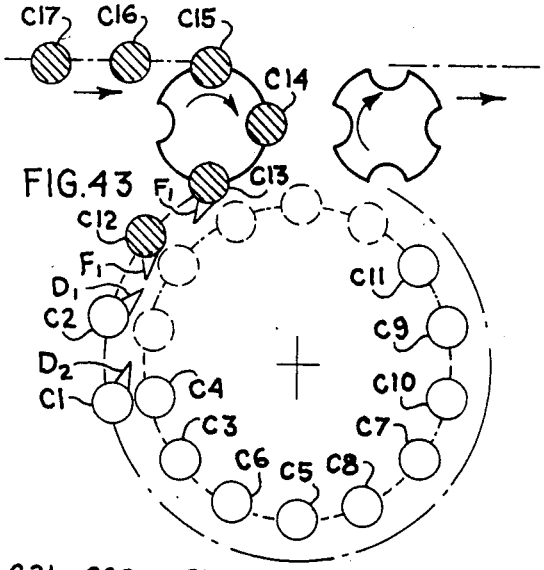
Figure 44:
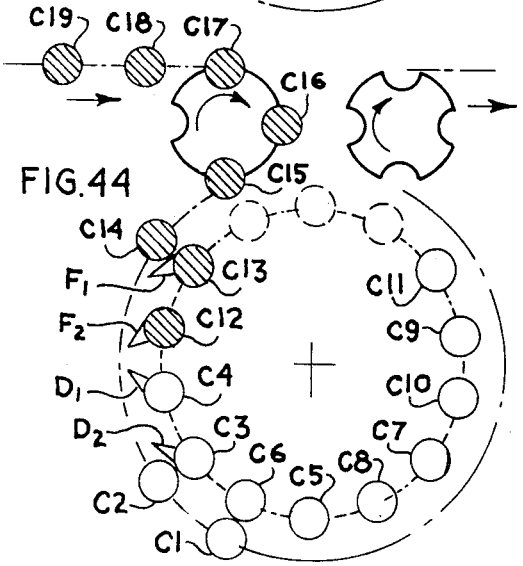
Figure 45:
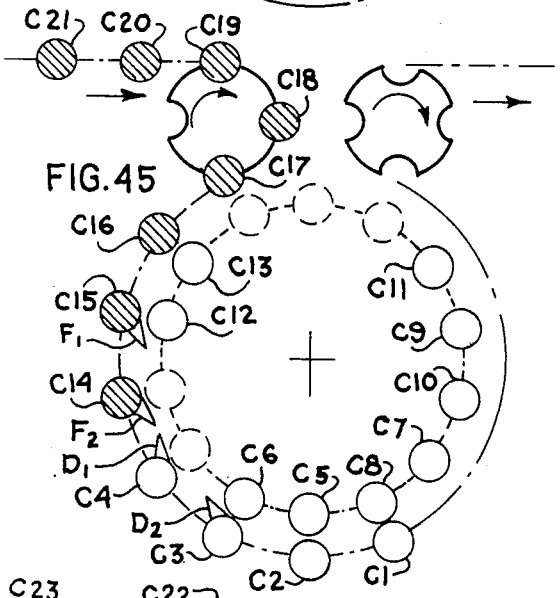

FIG. 42 shows containers C1 to C11 at the eleven operative and usable positions of the fourteen position machine. It should be noticed that the containers are reversed in pairs, namely in the sequence C2, C1, C4, C3, C6 etc., although these containers were fed by the star wheel 16 in strict numerical sequence C1, C2, C3 etc. The two feeder guides $F_1$, $F_2$ are disposed adjacent two inoperative placement positions, and the two discharge guides are adjacent processed containers C2, C1. Containers C12 and C13 are in the supply star wheel 16 with containers C14 and C15 shown near the exit end of the container separating device 14. No containers are shown as having yet reached the exit star wheel 20 and exit conveyor 22.

Figure 46:
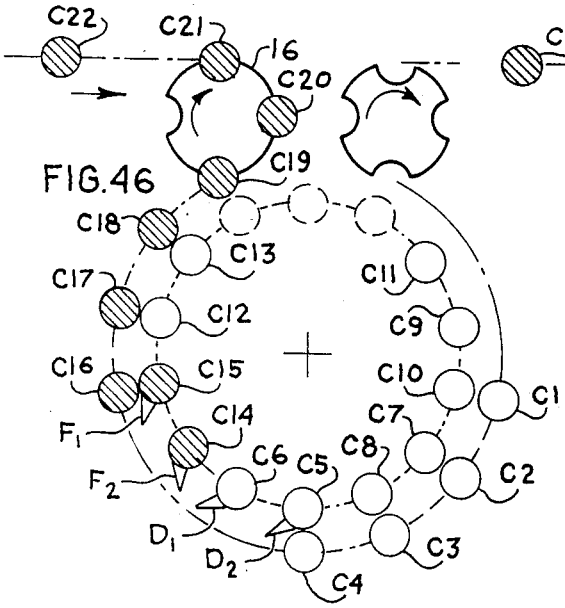
Figure 47:
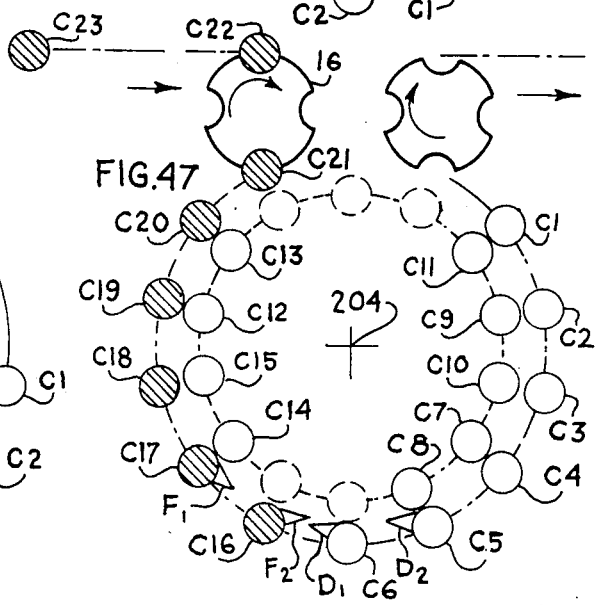

FIGS. 43 to 46 illustrate successive pairs of containers C2, C1; C4, C3; and C6, C5 being sequentially removed from their placement positions by the guides $D_1$, $D_2$ and discharged onto the outer rotary turntable (46 in FIG. 1). At the same time new pairs of containers C13, C12; C15, C14 are sequentially placed at vacated placement positions by the feeder guides $F_1$, $F_2$. Containers C16, C17 and C18 are being conveyed by the outer turntable towards and catching up with the feeder guides $F_1$, $F_2$ with FIG. 46 showing the lead unplaced container C16 passing outside the trailing feeder guide $F_1$ which is turned inwardly placing container C15. Further containers are being fed to and through the supply star wheel 16, and it should be noted in FIG. 46 that an empty space is created between approaching containers C21 and C22. The discharge and then placement of containers in pairs continues in FIG. 47 with the leading discharged container C1 approaching the exit star wheel 20. Discharged processed containers C1, C2, C3 and C4 can be seen moving ahead of the discharge guides $D_1$, $D_2$ in FIG. 47. Also, in FIG. 47 empty or unprocessed containers C18, C19, and C20 can be seen approaching the feed guides $F_1$, $F_2$. It should be noted in FIG. 47 that there is an empty space in the supply star wheel 16 between containers C21 and C22, and there are two empty spaces between the supply star wheel 16 and the next container C23 being supplied thereto; this is to account for the three placement positions immediately adjacent and between the supply and exit star wheels being inoperative and not used for container placement. Thus, the containers approach the placement apparatus in numerical sequence C1, C2 etc., get reversed in pairs C2, C1 etc. when placed at the operating placement stations, and then leave the placement apparatus in numerical sequence C1, C2 etc. The pairs of guides $F_1$, $D_1$; $F_2$, $D_2$ move along two angularly displaced epicycloidal paths as these guides move around the central axis 204; the guides move around the axis 204 at one half the rate of rotation of the turntable 46 (see FIG. 1) about axis 204.

Turning now to FIGS. 48 to 57, these illustrate a fourteen position machine having two sets of double feeder and discharge guides $F_1$, $D_1$; $F_2$, $D_2$; $f_1$, $d_1$; and $f_2$, $d_2$. It will be noted that the feeder guides are grouped in pairs $F_1$, $F_2$ and $f_1$, $f_2$, and the discharge guides are grouped in pairs $D_1$, $D_2$ and $d_1$, $d_2$ downstream of the respective pairs of feeder guides. The feeder guides $f_1$, $f_2$ are arranged diametrically opposite the respective feeder guides $F_1$, $F_2$, and the discharge guides $d_1$, $d_2$ are diametrically opposite the discharge guides $D_1$, $D_2$. In this arrangement, the four placement positions nearest the supply and exit star wheels are left inoperative and not used. With the machine in continuous operation, consecutive FIGS. represent steps of one fourteenth of a revolution of a spider carrying the two sets of double guides, one set being $F_1$, $f_1$, $D_1$, $d_1$ and the other set being $F_2$, $f_2$, $D_2$, $d_2$. Consecutive Figs. also represent one seventh of a revolution of the outer annular turntable (46 in FIG. 1) conveying the moving containers around the central axis 204.

Due to the sequencing and movement of the containers being more complex in this multiple set, double guide configuration, the containers are referenced differently than before. The letter E is used for empty or unprocessed containers (which are also shown cross-hatched), and the letter P is used for processed containers or containers being processed (such containers being shown as an empty circle). The letters E and P are followed by the number of the placement position at which the containers will be processed, are being processed, or have been processed. The upper four placement positions, which are inoperative and not used, are not numbered. The remaining ten placement positions are numbered consecutively 1 to 10 in a counterclockwise direction, i.e. the direction in which the machine rotates. Thus, for example, an unprocessed container to be placed at position 4 is referenced E4; when this container is being processed at position 4 it is referenced P4, and after the processed container is discharged from position 4 it is also referenced P4. Some references will appear twice in some Figs. because while a container is being processed at a placement position, another container previously processed at that position may still be on the annular turntable or moving through and beyond the exit star wheel; for example, in FIG. 48 the reference P4 appears twice.

Figures 48, 49, 50, 51, 52, 53:
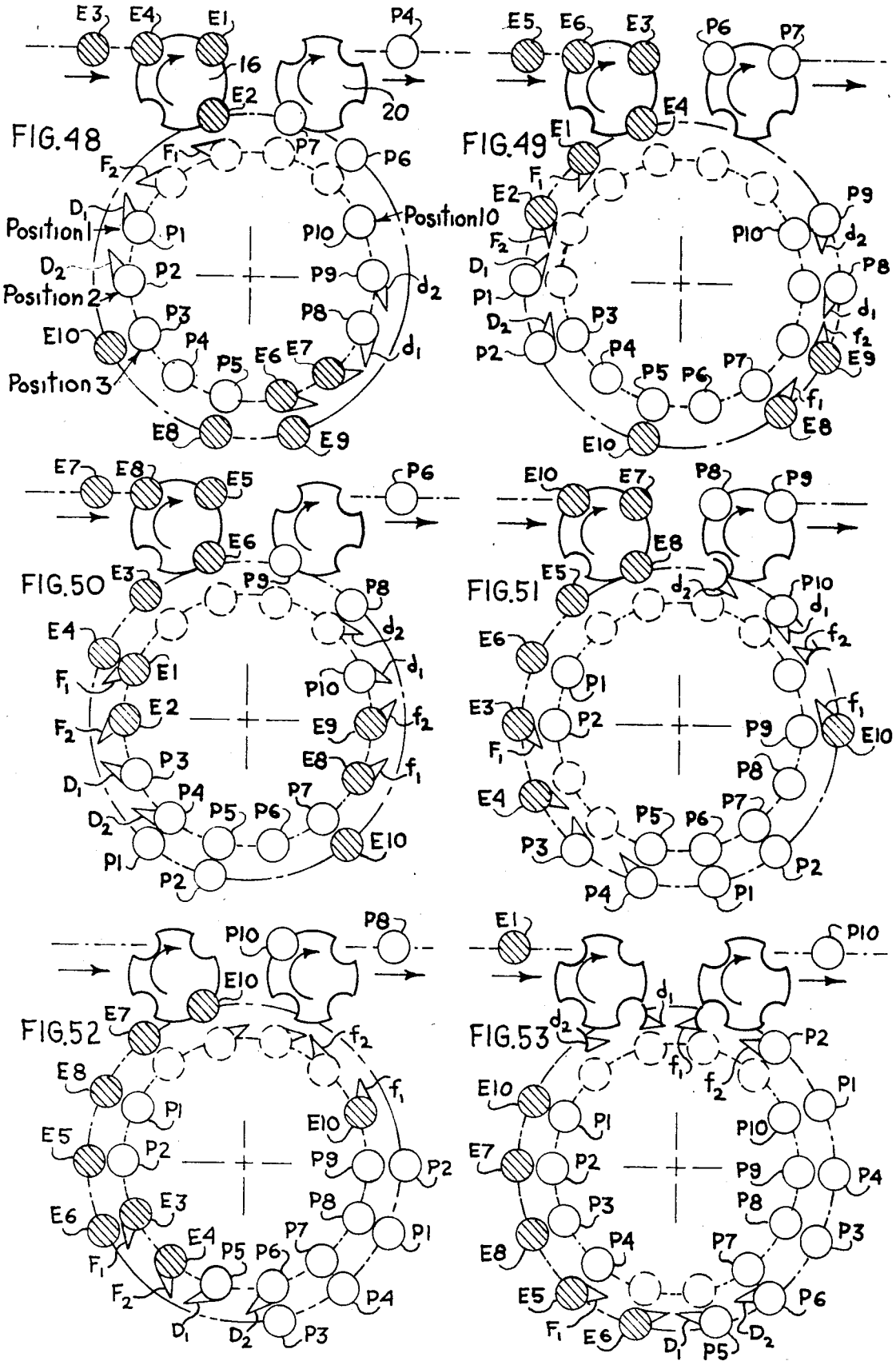
FIGS. 48 to 57 are schematic plan views illustrating a fourteen position container placement apparatus of the invention with two sets of double feeder and discharge guides in operation, these guides being shown in successive positions in placing and removing two pairs of containers at a time.
Figure 54:
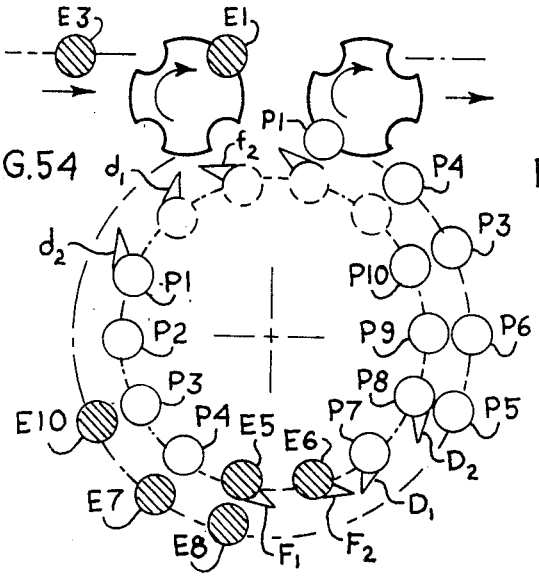
Figure 55:
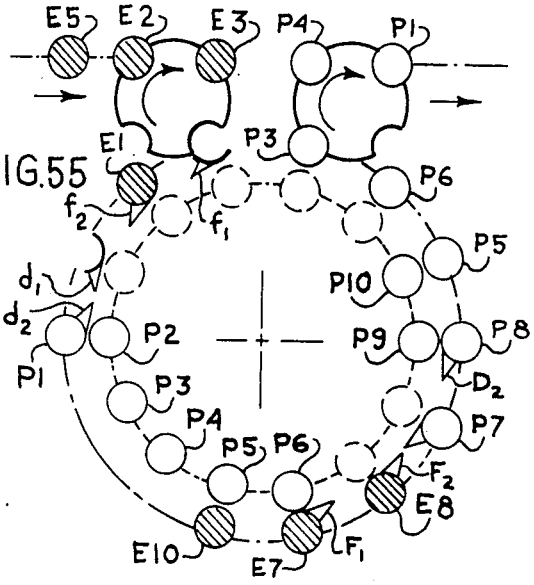
Figure 56:
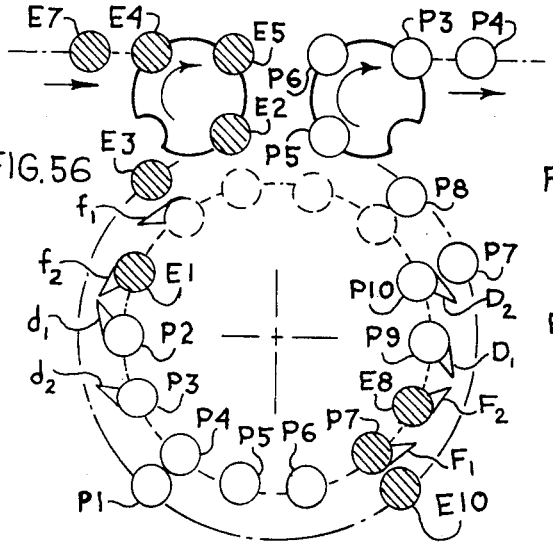
Figure 57:
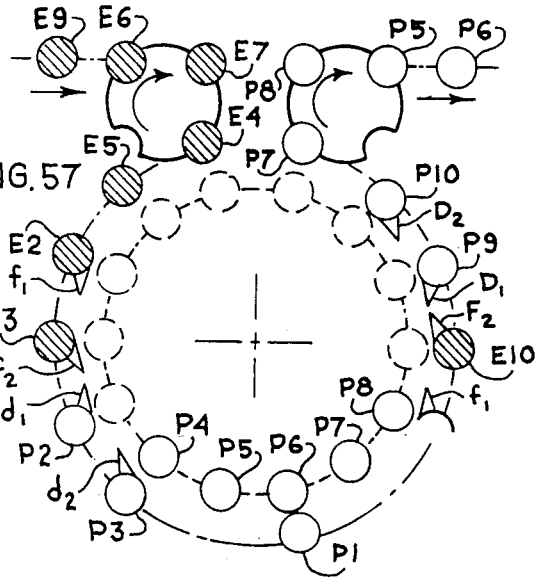

FIG. 48 illustrates the machine in operation with an empty container E3 approaching the transfer star wheel 16, and empty containers E4, E1 and E2 in the star wheel 16. The feeder guides $F_1$, $F_2$ are empty, and the discharge guides $D_1$, $D_2$ are about to discharge processed containers P1, P2 at positions 1 and 2 onto the annular turntable. Processed containers P3, P4, P5 rest at positions 3, 4 and 5, and an empty container E10 is being moved by the annular turntable past position 3. Empty containers E8, E9 are moving past positions 5 and 6. Empty containers E6, E7 have just been placed at positions 6 and 7 by feeder guides $f_1$, $f_2$ while discharge guides $d_1$, $d_2$ are about to discharge processed containers P8, P9 onto the annular turntable. A processed container P10 is at rest at position 10, and processed container P6 on the annular turntable is approaching the exit star wheel 20. Processed container P7 is in the exit star wheel, and processed container P4 is being conveyed from the exit star wheel.

In FIG. 49 the containers E1, E2 have been received in the feeder guides $F_1$, $F_2$. Processed containers $P_1$, $P_2$ have been placed on the annular turntable by discharge guides $P_1$, $P_2$ leaving positions 1 and 2 open. The other feeder guides $f_1$, $f_2$ have been engaged by empty containers E8, E9, and the other discharge guides $d_1$, $d_2$ have just placed processed containers P8, P9 on the turntable, so leaving positions 8 and 9 open.

A further increment of rotation of the machine results in the situation in FIG. 50. The feeder and discharge guides have oscillated inwardly, and containers E3, E4, P1, P2, E10 and P8 are being conveyed around the central axis and outside the placement positions by the turntable. It should be noted that the discharge guide $d_2$ is positioned at one of the inoperative placement positions and will, therefore, not pick up a container.

FIGS. 51 through 57 illustrate the progress of the containers and operation of the two sets of double feeder and discharge as the machine moves through further successive increments of rotation. It should be noted that in FIG. 53, the feed of empty containers is sequenced to omit an empty container E9 to avoid interference with the discharge guide $d_2$; this will subsequently cause the position 9 to remain open for half a revolution of the machine. It will also be noticed in FIG. 53 that the processed container P2, on the turntable and about to enter the exit star wheel, has been intercepted by the feeder guide $f_1$; this will prevent this container entering the exit star wheel and cause it to be placed at an inoperative placement position. To avoid this situation, the reason for which will be explained below, the empty container resulting in this misplaced container P2 would be omitted from the sequenced feed of empty containers to the star wheel 16. This misplaced container has been omitted from FIGS. 54 to 57. It will also be noticed how both empty and processed containers are spaced apart in various sequences on the outer annular turntable.

Some of the irregular sequencing of supply of the empty containers is because the machine of FIGS. 48 to 57 has an odd number of pairs of placement positions. With fourteen nominal placement positions, of which ten are used, this results in seven diametrically opposite pairs of positions and so seven adjacent pairs of positions. This causes the pairs of feeder and discharge guides to be out of phase one position each revolution of the guides about the axis 204. For example, in FIG. 50 the pair of adjacent feeder guides $F_1$, $F_2$ are placing empty containers at positions 1 and 2; subsequently, after just over one half revolution of the spider supporting the guides, the other pair of feeder guides $f_1$, $f_2$ will place empty containers at positions 2 and 3 as can be understood by continuing the sequence of incremental rotation one increment from the position in FIG. 57.

It is preferred, therefore, when using a plurality of pairs of feeder and discharge guides, to employ for the number of placement positions a number which is a multiple of four.

In the foregoing embodiments, the transfer star wheels 16, 20 each comprise a pair of vertically spaced apart disks of identical configuration, and the feeder and discharge guides are arranged to be able to pass between these disks so avoiding any interference between the oscillating guides and the rotating star wheels.

Figure 58:
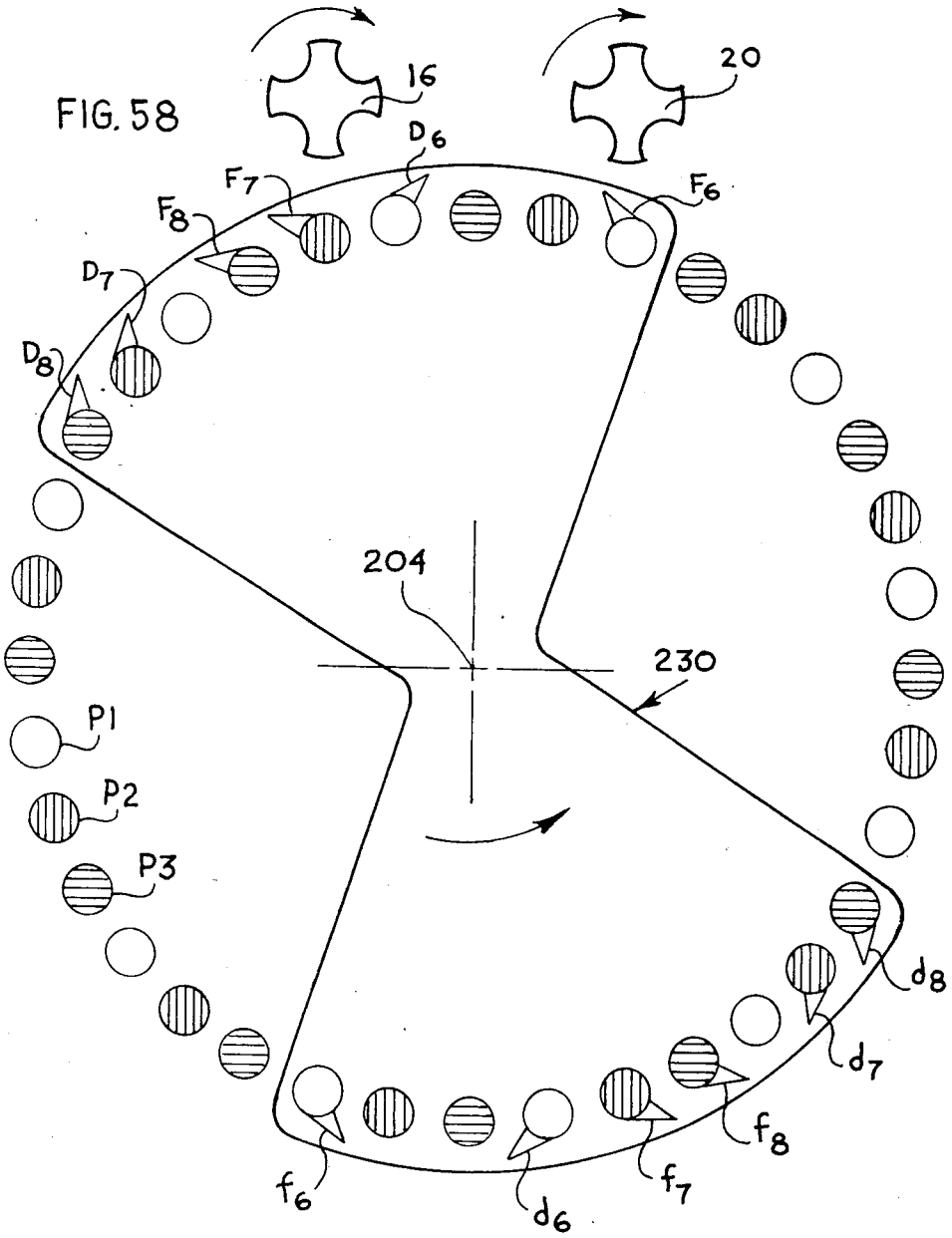
FIG. 58 is a schematic plan view illustrating a thirty-six position machine having three sets of double feeder and discharge guides somewhat similar to that illustrated in FIG. 41 but having a different grouping of the guides.

FIG. 58 illustrates another guide configuration for a thirty-six position machine having three sets of double feeder and discharge guides. The machine has three pairs of feeder and discharge guides $F_6$, $D_6$; $F_7$, $D_7$; $F_8$, $D_8$ grouped together in a 90 degree segment of the machine, and three diametrically opposite pairs of feeder and discharge guides $f_6$, $d_6$; $f_7$, $d_7$; $f_8$, $d_8$ grouped together in a diametrically opposite 90 degree segment of the machine. The guides are all mounted on a spider unit 230 which rotates counterclockwise about the central axis 204. The guides $F_6$, $D_6$ are spaced apart by three placement positions, the feeder guides $F_7$ and $F_8$ are spaced apart by one placement position with the guide $F_7$ being spaced one placement position from the discharge guide $D_6$. The discharge guides $D_7$ and $D_8$ are spaced apart one placement position with the guide $D_7$ being spaced two placement positions from the feeder guide $F_8$. The diametrically opposite guides are similarly spaced in the sequence $f_6$, $d_6$, $f_7$, $f_8$, $d_7$, $d_8$. All guides oscillate inwards simultaneously and then outwards simultaneously. The guides rotate about the central axis at half or less, but preferably half, of the speed of rotation of the outer annular turntable moving the unprocessed and processed containers around axis 204. The placement positions operated upon by the pair of guides $F_6$, $D_6$ are illustrated as open circles. The placement positions operated upon by the pair of guides $F_7$, $D_7$ are illustrated as circles with vertical lines, and the placement positions used by guides $F_8$, $D_8$ are shown as circles with horizontal lines. The pairs of guides $f_6$, $d_6$; $f_7$, $d_7$; $f_8$, $d_8$ operate respectively on the same placement positions as the guide pairs $F_6$, $D_6$; $F_7$, $D_7$; $F_8$, $D_8$. In this machine, the six placement positions adjacent the transfer star wheels 16, 20 are left inoperative and are so illustrated in broken lines. This guide configuration of FIG. 58 can be useful with smaller diameter machines, particularly when employing less placement positions. However, normally the guide configuration of FIG. 41 would be preferred for a machine having three sets of double guides.

In the foregoing embodiments having various configurations of multiple guides, various placement positions have been indicated to be inoperative. Also, transfer star wheels having two and four cavities are illustrated. There is a relationship between the number of inoperative placement positions and the star wheels. The number of inoperative or unusable placement positions depends, inter alia, upon the location of the star wheels. The closer the star wheels can be placed together, the fewer placement positions will be lost.

When a container is placed onto the outer annular turntable adjacent the exit star wheel by a discharge guide, this guide should not only have released the container before the latter enters the star wheel, but this discharge guide should be on its way towards the next stationary position to be out of the way of the container which it has just released, the released container now following the path of the exit star wheel and no longer its normal path on the outer annular turntable. The situation with a feed guide and containers supplied by the other star wheel is the same. For example, the spacing of the containers in their stationary positions above a stationary gear (e.g. 78) with a diameter of 60 inches, and employing epicycloidal curves having rolling generating circles of 5 inch diameter, will be $pi \times 5 = 15.707$ inches if only one set of guides is used in a machine having one series of twelve placement positions. For a machine with two such series and with two sets of guides, the spacing will be half, i.e. 7.854 inches; and for a machine with three such series and three sets of guides, the spacing will be 5.236 inches.

For such a machine with three series of twelve positions (i.e. thirty-six positions as in FIGS. 41 and 58), the spacing of the containers on the outer annular turntable will be $5.236 \times 35/30 = 6.1086$ inches. The spacing of the containers on the star wheels should be exactly the same and is therefore, also 6.1086 inches. For a star wheel with one cavity, the pitch diameter would be 6.1086 divided by pi, i.e. 1.944 inches; for a star wheel with two cavities, the pitch diameter would be 3.888 inches, and for one with three cavities this pitch diameter would be 5.833 inches. Considering containers of up to 4 inches diameter, a three cavity star wheel is the smallest one desirable to use. The distance between the centers of the two star wheels will be somewhat larger than twice the pitch radius of the star wheels, i.e. the pitch diameter of one star wheel, plus the diameter of the largest container. In the present example the distance between the centers of the star wheels would be greater than 5.833 inches plus 4 inches, i.e. greater than 9.833 inches; the centers of the star wheels would, therefore, preferably be spaced apart about 11 inches.

In general, the placement positions falling in the segment defined by the centers of the star wheels and the central axis of the annular turntable will be unusable. Sometimes one position on each side of this segment should also be left inoperative.

FIGS. 59 and 60 show another embodiment of the container placement apparatus of the invention. The main difference in the machine of FIGS. 59 and 60 to that described in relation to FIGS. 21 and 22 is that the previous large internal tooth gear 78 is replaced by a plurality of smaller spur gears which run around the periphery of a central stationary spur gear similar to the stationary gear 72 in FIGS. 21 and 22. Another significant difference concerns the arrangement for oscillating the feeder and discharge guides. The machine of FIGS. 59 and 60 is adapted for, and preferred for, carrying out multi-feeder and discharge guide configurations as shown in FIGS. 37 to 41, FIGS. 42 to 47, FIGS. 48 to 57, and FIG. 58. The machine of FIGS. 59 and 60 generally functions similarly to the previously described machine of FIGS. 21 and 22, including employment of the arrangements of FIGS. 1 and 33, and only the main differences will be described in detail.

FIG. 59 is a view generally similar to that of FIGS. 21 and 22, but with some parts omitted for clarity and with many parts sectioned to show more detail. The container placement apparatus has a central non-rotatable shaft 300 rigidly secured to the base (not shown) of the machine and extending vertically upwards therefrom. The central axis of the shaft 300 defines the central axis 204 previously referred to and which is the axis of rotation of the machine (same as axis 44 in FIGS. 1, 2 and 21). A hub 302 is rotatably mounted via a sleeve bearing 304 near the bottom of the shaft 300. The hub is drivingly rotated by an electric motor (not shown) via a transmission (not shown). A large disk-like plate 306 is rigidly attached to the hub 302, the plate 306 extending horizontally and carrying around its outer periphery a plurality of upwardly extending tubes 308 (which function the same as the rods 71 in FIG. 21). The upper ends of the tubes 308 (only one of which can be seen) support the annular turntable 46 previously described. An upper stationary platform 310 has a central boss 312 non-rotatably secured to the top of the shaft 300. The upper surfaces of the platform 310 and the annular turntable 46 are in the same horizontal plane with a small annular gap 314 between the platform 310 and turntable 46. Under each operative placement position around the periphery of the platform 310 are load cells one of which is schematically illustrated in broken lines and referenced 316.

The upper end of the hub 302 integrally carries a small gear 318 which drivingly meshes with a larger gear 320 keyed on the lower end of a lay shaft 322. A large stationary gear 324 has a central hub 326 which is mounted on the shaft 300 and keyed thereto by a key 328. The hub 326 is immediately adjacent the upper end of the rotatable hub 302. A shaft support 330 extends through and is rigidly supported by the stationary gear 324, the lay shaft 322 being journalled in a sleeve bearing 332 in the support 330. The gear 324 has around its outer periphery teeth 334 with which mesh teeth 336 of a smaller spur gear 338. The gear 338 is keyed on the lower end of a shaft 340 for rotation and movement thereof around the stationary gear 324.

Immediately above the stationary hub 326, three further hubs 342, 344, and 352 are rotatably mounted on the central shaft 300 via sleeve bearings 348, 350, and 352, respectively, with the upper hub 346 terminating next to the platform 310. The lower end of the hub 342 integrally carries a spur gear 354 which meshes with and is driven by a spur gear 356 keyed on the upper end of lay shaft 322. A disk-like spider 358 is rigidly attached to and supported by the upper end of the hub 342. This spider 358 corresponds to the units 200, 206, 212, 218, 220, 222, and 230 in FIGS. 36 to 41 and FIG. 58. Adjacent and spaced around its outer periphery, the spider 358 carries a plurality of vertical shaft mountings 360 (only one of which can be seen in FIG. 59), each rotatably carrying a shaft 340 via a sleeve bearing 362. A guide drive disk 364 is keyed on the upper end of each shaft 340. Eccentrically mounted on and above the disk 364 is a stub shaft 366 on which is rotatably mounted a crank sleeve 368 via a sleeve bearing 370. The crank sleeve 368 carries a crank lever 372 which has a boss 374 at its distal end. A guide support pin 376 is mounted in and carried by the boss 374, the lower end of the pin 376 being keyed in the boss 374 to prevent relative rotation therebetween. The guide support pin 376 extends vertically upwards through the annular gap 314 and carries a feeder or discharge guide 378 on its upper end. The guide 378 can be any of the feeder or discharge guides previously discussed in relation to FIGS. 36 through 58. Above the boss 374, a sleeve 380 is rotatably mounted on the guide support pin 376 via a sleeve bearing 382. The sleeve 380 is rigidly attached to the upper hub 346 by a bar 384. The bar 384 extends generally radially from the hub 346 and causes the pin 376 to remain centralized in the annular gap 314 as the pin 376 moves about the central axis 204. A similar bar 386 (part of which can be seen) is rigidly attached at its inner end to the lower hub 344, and is rigidly attached at its radially outer end to the corresponding sleeve 380 of another guide support pin. If the guide 378 is a feeder guide, then the bar 386 would be rotatably connected to the support pin of the corresponding discharge guide, and vice versa.

Rotation of the lowest hub 302 causes rotation of the turntable 46 and also the gear 318. Rotation of the gear 318 causes rotation of the spider 358 via the reduction gear train 320, 356 and 354. Rotation of the spider causes the spur gear 338 to roll around the stationary gear 324 in mesh therewith, this causing the shaft 340 to rotate about its axis 390 as its axis 390 is moved around the central axis 204, the axis 390 always extending through the annular gap 314. Rotation of the shaft 340 causes rotation of the eccentric shaft 366 about the axis 390 with the axis 392 of the eccentric shaft 366 being and remaining on the pitch circle of the teeth of the gear 338. Since the radial distance of the guide support pin 376 from the central axis 204 is dictated by the bar 384, as the eccentric shaft 366 rotates with the disk 364 about the axis 390, the guide pin 376 is caused to oscillate along the annular gap 314 in a direction perpendicular to the plane of FIG. 59; the lever 372 functions as the connecting rod in a crank arrangement, the shaft 340 and disk 364 functioning as a crank shaft, and the guide rod 376 functioning as a reciprocating piston. Further, as the pin 376 is keyed in the boss 374, and so cannot rotate relative to the lever 372, the pin will oscillate about its axis 394 as it is oscillated along the annular gap 314; this in turn causes the oscillation of the guide 378 for feeding or discharging containers to or from, as the case may be, placement positions on the stationary platform 310. It will be realized, therefore, that the axis 392 of the eccentric shaft 366 defines an epicycloidal path around the stationary gear 324 as the gear 338 rotates therearound.

The geometrical relationship of the boss 368, the lever 372, the pin 376, and the guide 378 is the same as that of the upper half of the guide and lever operating mechanism shown in FIGS. 34 or 35, with these parts corresponding respectively to parts 88, 92, 93 and 48 or 122, 125, 127 and 50. In FIG. 59, the axis 392 of the eccentric shaft 366 corresponds to either the axis 90 in FIG. 34 or the axis 124 in FIG. 35 depending upon whether the guide 378 is a feeder or discharge guide. Thus, the guide 378 maintains the center axis of a container coaxial with the axis 392 while the guide is contacting and moving the container.

A stationary deck 396 is disposed outside the annular turntable 46. At a suitable location, the star wheels 16, 20 (see FIG. 1) are located over this deck.

FIG. 60 is a simplified plan view of a portion of the machine of FIG. 59 and shows a feeder guide 378F and two discharge guides 378D, each corresponding to the guide 378 in FIG. 59. Three gears 338, one for each guide, are shown in broken lines and in mesh with the single stationary gear 324, also shown in broken lines. The shaft 340 of each gear 338 can be seen through the annular gap 314. The tops of three guide support pins 376 can be seen and the crank levers 372 are shown in broken lines connecting these pins 376 to three respective eccentric shafts 366. The oscillation of guide support pins along the annular gap 314 is indicated by the double headed arrow 402 adjacent the lower guide support pin 376; this oscillation occuring as the turntable 46 and the gear shafts 340 move around the central axis 204 in the direction of the arrow 404. The bars 384, 386, determining the radial spacing of the guide support pins 376 from the central axis 204, each have forked outer ends, both fork prongs 386A and 386B of the bar 386 being shown but only one fork prong 384B of the bar 384 being shown. In this way, the pair of adjacent discharge guides 378D can be controlled by one bar 386, the fork prongs 386A and 386B respectively being rigidly connected to the sleeve 380 (see FIG. 59) associated with the respective guide support pin 376. Similarly, two adjacent feeder guides can be controlled by the bar 384. As will be appreciated, although the feeder and discharge guides oscillate simultaneously, the feeder guides oscillate out of phase to the discharge guides with respect to the central axis 204; in this respect, note the relative positions of the guide support pins 376 with respect to the shafts 340 for the feeder guide and the discharge guides in FIG. 60. Consequently, the bars 384 and 386 will oscillate with respect to each other, in the same manner as indicated by the arrow 402, as the bars 384, 386 rotate about the central axis 204.

Arcuate stops 398, mounted on the platform 310 by blocks 400, stop and locate the containers at their respective stationary placement positions. It will be realized that in operation, the feed guide 378F will place a container against the center stop 398 of the three stops shown.

The ratio of the reduction gearing 318, 320, 356 and 354 in FIG. 59 determines the relative rates of rotation of the annular turntable 46 and the spider 358. Preferably, as mentioned, the turntable 46 rotates twice as fast as the spider 358.

Figure 61:
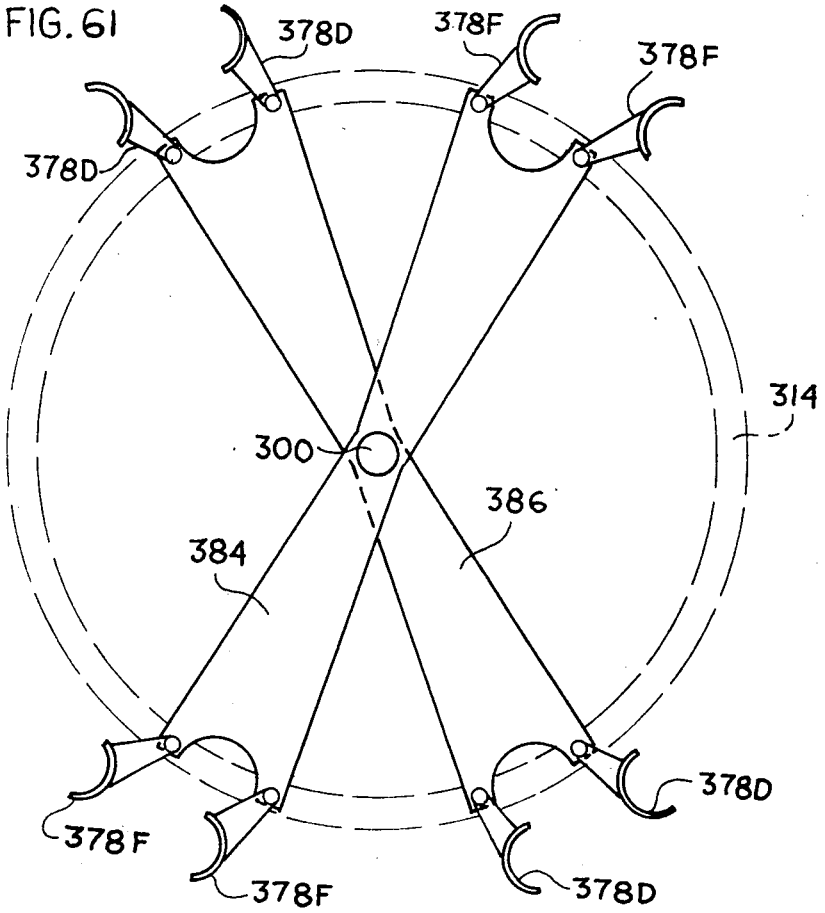
FIG. 61 is a schematic plan view of a modification of the apparatus of FIG. 59 illustrating the connection of one set of double feeder and discharge guides.

FIG. 61 is a schematic plan view of the above machine when a guide configuration such as shown in FIGS. 48 to 57 is required for two sets of double feeder and discharge guides. For simplicity, the annular gap 314 is shown in broken lines. Each bar 384, 386 extends symmetrically to the opposite side of the central shaft 300, so that each bar extends generally along a respective diameter of the circle defined by the outer periphery of the annular gap 314. A pair of discharge guides 378 are connected to each end of the bar 386, and a pair of feeder guides 378F are connected to each end of the bar 384.

Figure 62:
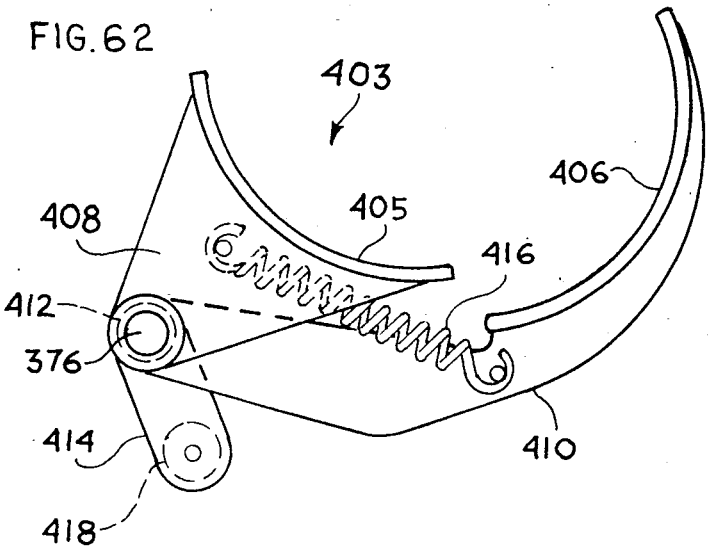
FIG. 62 is a plan view of a preferred two part guide according to the invention.
Figure 63:
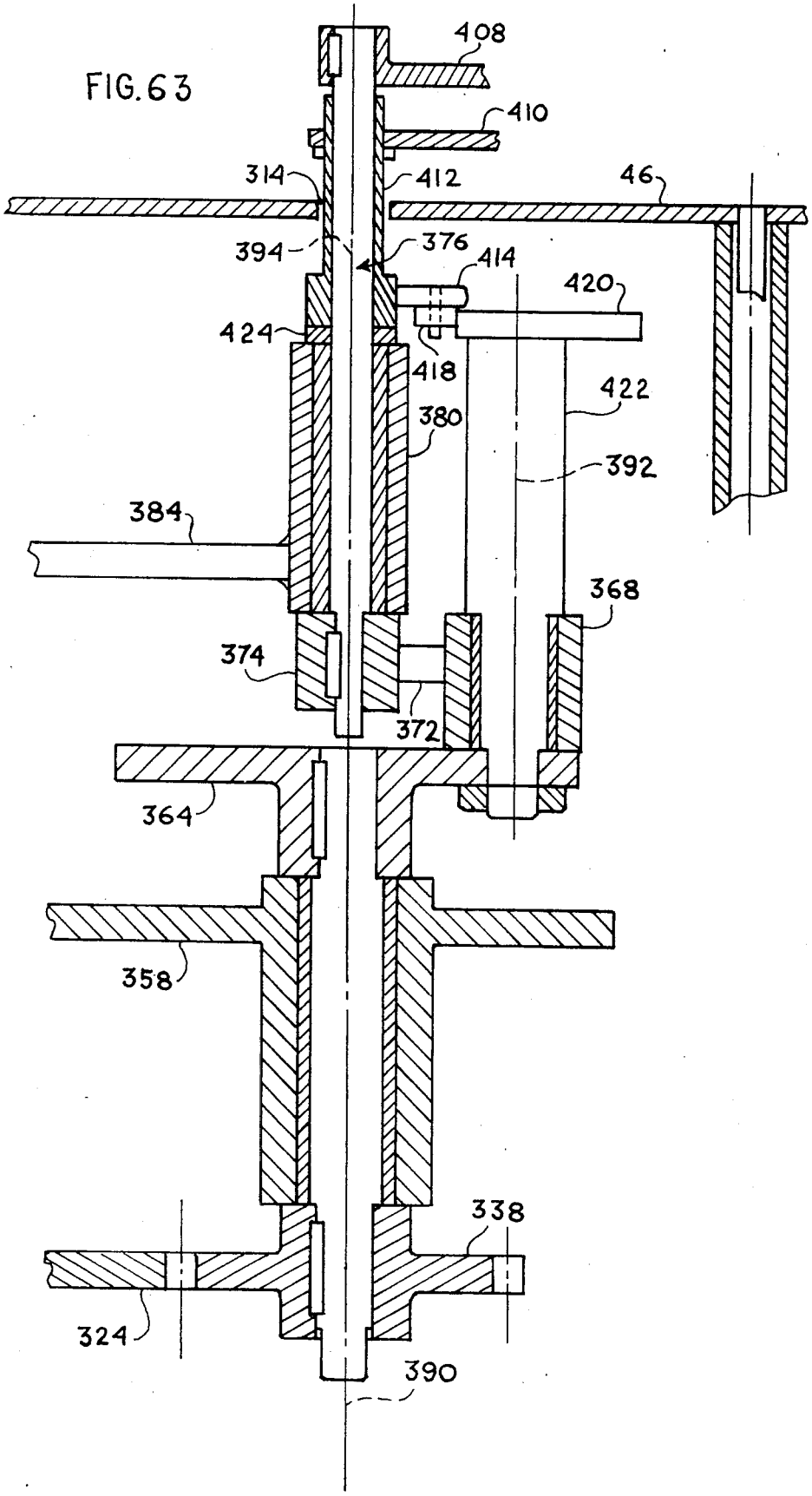
FIG. 63 is a fragmentary view similar to part of FIG. 59 but showing mechanism for operating the two part guide of FIG. 62.

FIGS. 62 and 63 illustrate a preferred two part feeder or discharge guide and its operating mechanism. FIG. 62 is a plan view of this guide in an open position (corresponding to the position of the guides in FIG. 60), and FIG. 63 illustrates a consequential modification of part of FIG. 59. Parts similar to those in FIGS. 59 and 60 are referenced the same in FIGS. 62 and 63.

The guide 402 has a shorter arcuate wall 404 and a longer arcuate wall 406, which when they come together from the open position shown in FIG. 62, form a continuous arcuate wall 402, 406 defining a circular arc extending over more than 180 degrees, i.e. greater than a semi-circle. This provides a better grip around a circular container for positively retaining the container. The inner arcuate wall 404 is mounted on a plate 408 mounted on and keyed to the top of the guide support pin 376. The outer arcuate wall 406 is mounted on an arm 410, the inner end of the arm 410 being rigidly secured to and supported by a sleeve 412 rotatably mounted on the pin 376. The arm 410, although spaced above the turntable 46, is spaced below the plate 408 as more clearly shown in FIG. 63. A cam follower arm 414 is rigidly secured to the sleeve 412 and extends horizontally away from the pin 376 to one side of both the plate 408 and the arm 410. A coil spring 416 is tensioned between the plate 408 and arm 410 to bias these parts towards the closed position of the guide. The ends of the spring 416 is attached by studs 418, 420 respectively on the underside of plate 408 and the upper side of arm 410, the spring 416 extending in the gap between the plate 408 and the arm 410. The arcuate walls 404, 406 are held in the open position of FIG. 62, against the tension in the spring 416, by a cam follower roller 418, rotatably mounted on the distal end of the arm 414, being engaged by the cam surface of a cam 420 (see FIG. 63). Upon the cam 420 permitting counterclockwise movement of the follower arm 414, the spring 416 rotates the arm 410 relative to the plate 408 to move the outer arcuate wall section 406 counterclockwise until the guide 402 is in the closed position. The spring 416 also allows some tolerance if the container is slightly oversize, the adjacent ends of the walls 404, 406 then not quite coming together and the wall sections 404, 406 engaging the container in a vice-like grip under the tension of the spring 416.

As shown in FIG. 63, the eccentric shaft 368 is provided with a larger diameter upward extension 422 on the top of which is rigidly secured the cam 420. The cam, therefore, does not rotate about the eccentric axis 392, but moves with the shaft 368 about the axis 390 at the same time as the axis 390 moves about the central axis of the machine. In other words, the cam 420 is moved around the same epicycloidal path as the guide 402, except vertically therebelow. The cam follower arm 414 extends from an enlargement at the lower end of the sleeve 412; a washer 424 is sandwiched between this enlargement and the upper end of the sleeve 380. The sleeve 412 can be seen extending upwardly through the annular gap 314. As can more readily be appreciated from FIG. 13, as the cam 420 moves about the guide support pin 376, and as this pin 376 oscillates backwards and forward along the annular gap 314 relative to the axis 390, the roller 418 will move around the cam surface of the cam 420. The cam 420 is shaped to cause the guide 402 to be open when receiving or releasing a container and also when not holding a container, and to allow the guide to close whenever holding and moving a container.

It will now be appreciated, that in FIGS. 36 to 41, the circles used schematically to represent the various feeder and discharge guides, more accurately illustrate the positions of spur gears 338 supporting and operating the guides, these gears 338 being mounted on the spider 358.

Below are some charts giving examples and comparisons of different configurations and numbers of feeder and discharge guides in machines as shown in FIGS. 59 to 63. It will be appreciated that with the arrangement of smaller spur gears running around the outside of a larger stationary gear, higher machine speeds and more complex guide configurations are more readily possible.

The first chart gives a comparison between machines having gears 338 of 5 inch diameter, a stationary gear 324 of 80 inch diameter, 16 placement positions per row of containers, and with one, two and three sets of single or double guides. The machine operates at a high production line speed of 300 containers per minute. All dimensions are given in inches, seconds, and inches per second, as applicable.

| | 1 set Single | 1 set Double | 2 sets Single | 2 sets Double | 3 sets Single | 3 sets Double |
|---|---|---|---|---|---|---|
| Total Positions | 16 | 16 | 32 | 32 | 48 | 48 |
| Usable Positions | 15 | 15 | 30 | 30 | 45 | 45 |
| Spacing of Containers on Turntable 46 | 17.7 | 17.7 | 8.8 | 8.8 | 5.9 | 5.9 |
| Containers Replaced by One turn of Spider 358 | 15 | 30 | 30 | 60 | 45 | 90 |
| RPM of Spider | 20 | 10 | 10 | 5 | 6.1 | 3.3 |
| RPM of Turntable 46 | 40 | 20 | 20 | 10 | 13.3 | 6.6 |
| Speed of Containers on Turntable | 188 | 94.2 | 94.2 | 47.1 | 62.8 | 31.4 |
| Time cycle of Spider | 3 | 6 | 6 | 12 | 9 | 18 |
| Time cycle of Containers | 3 | 3 | 6 | 6 | 9 | 9 |
| Exchange time | 0.2 | 0.4 | 0.4 | 0.8 | 0.6 | 1.1 |
| Rest period of Containers | 2.8 | 2.6 | 5.6 | 5.2 | 8.4 | 7.9 |

The next chart gives a comparison between machines with two and three sets of double feeder and discharge guides at a line speed of 300 containers per minute. Again the dimensions are not shown but are in inches, seconds, and inches per second as applicable.

| | | | | | | |
|---|---|---|---|---|---|---|
| Number of Double sets | 2 | 3 | 2 | 3 | 2 | 3 |
| Diameter of Gears 338 | 5 | 5 | 5 | 5 | 6 | 6 |
| Total Positions | 24 | 36 | 32 | 48 | 32 | 48 |
| Usable Positions | 22 | 33 | 30 | 45 | 30 | 45 |
| Diameter of Gear 324 | 60 | 60 | 80 | 80 | 96 | 96 |
| Diameter of Turntable | 70 | 70 | 90 | 90 | 108 | 108 |
| Spacing of Containers on Platform 310 | 7.8 | 5.2 | 7.8 | 5.2 | 9.4 | 6.3 |
| Spacing of Containers on Turntable | 9.2 | 6.1 | 8.8 | 5.9 | 10.6 | 7.0 |
| Number of Containers Replaced each Revolution of Spider 358 | 44 | 66 | 60 | 90 | 60 | 90 |
| RPM of Spider | 6.8 | 4.5 | 5 | 3.3 | 5 | 3.3 |
| RPM of Turntable | 13.6 | 9.1 | 10 | 6.7 | 10 | 6.7 |
| Speed of Containers on Turntable | 50 | 33.3 | 47.1 | 31.4 | 56.5 | 37.7 |
| Time Cycle of Spider | 8.8 | 13.2 | 12 | 18 | 12 | 18 |
| Time Cycle of Containers | 4.4 | 6.6 | 6 | 9 | 6 | 9 |
| Exchange Time | 0.7 | 1.1 | 0.8 | 1.1 | 0.8 | 1.1 |
| Rest period of Containers | 3.7 | 5.5 | 5.2 | 7.9 | 5.2 | 7.9 |

The last chart gives a comparison between machines having three sets of double feeder and discharge guides with different numbers of total placement positions. In each case the gears 338 have a diameter of 3 inches, the spacing of the containers on the stationary platform 310 is 3.14 inches, and the line speed is 600 containers per minute. As before the dimensions are not shown but are inches, seconds, and inches per second as applicable.

| | | | | | |
|---|---|---|---|---|---|
| Total Positions | 48 | 60 | 72 | 84 | 96 |
| Usable Positions | 45 | 57 | 69 | 81 | 93 |
| Diameter of Stationary Gear 324 | 48 | 60 | 72 | 84 | 96 |
| Diameter of Turntable | 54 | 66 | 78 | 90 | 102 |
| Spacing of Containers on Turntable | 3.53 | 3.45 | 3.40 | 3.36 | 3.33 |
| Containers Replaced each Spider Revolution | 90 | 114 | 138 | 162 | 186 |
| RPM of Spider | 6.7 | 5.2 | 4.3 | 3.7 | 3.2 |
| RPM of Turntable | 13.3 | 10.5 | 8.7 | 7.4 | 6.5 |
| Speed of Containers on Turntable | 37.7 | 36.3 | 35.5 | 34.9 | 34.5 |
| Time Cycle of Spider | 9 | 11.4 | 13.8 | 16.2 | 18.5 |
| Time Cycle of Containers | 4.5 | 5.7 | 6.9 | 8.1 | 9.2 |
| Exchange Time | 0.6 | 0.6 | 0.6 | 0.6 | 0.6 |
| Rest Period of Containers | 3.9 | 5.1 | 6.3 | 7.5 | 8.6 |

As will be appreciated from the foregoing, by selecting the multiple feeder and discharge guide configuration and the total number of placement positions, the period of rest of the containers at the placement positions can be varied and, if required, made quite long upto for example 7 or 8 seconds. Further, arrangements can be selected which provide a moderately low container speed on the turntable while still being able to handle containers being supplied at a high line speed.

Although the above embodiments employ epicycloidal paths for the containers, it will be appreciated that any epicycloidal type path generated by a point of a circle rolling around any suitable closed circuit could be used. For example, a base path of two straight lines connected by semi-circles would be possible. The paths so generated for the feeder and discharge guides, although not true epicycloidal paths, are intended to be covered by the expression epicycloidal type path.

When four sets of feeder and discharge guides are used and these are located 90 degrees from each other, each container can be arranged to be placed twice, i.e. placed at two different placement positions. It is then possible to fill with two different products and each filling weighed.

Also, with longer rest times for the containers at the placement positions possible, each container could be completely filled from empty while at its placement position. First the container could be rapidly filled volumetrically to say 90 to 98 percent of the desired net weight. Then the filling could be completed slowly in conjunction with weighing until the desired net weight was reached, the net weight then being within close tolerances.

Thus, it can be seen from the foregoing that the container placement method and apparatus of the present invention provide an effective way to smoothly decelerate a container, hold the container in a rest position for a predetermined amount of time, and smoothly accelerate the container and return it back to high line speed.

It will be appreciated from the above that there is provided a novel container placement device for use in conjunction with filling devices which dispense product within very close tolerance of a desired weight. Such placement device decelerates the containers from high line speed to a stop for the filling operation, and after an adequate rest period accelerates them to the full line speed. Each container is automatically handled on an individual basis to insure accurate filling by weight thereof.

It should be understood that the above embodiments have mainly been described for handling containers in a filling or dispensing apparatus or for check weighing the containers. However, it will be appreciated that the present method and apparatus can be used to handle a variety of items or products. For example, the invention could be used for filling containers or bottles with liquid. Also, the invention could be used for processing various types of containers, for example containers having a square-like cross-section such as some instant coffee jars, or bottle-like containers, etc. With non-circular cross-sectioned containers, the invention could advantageously be used in applying labels to the containers while stationary at the placement positions.

The above described embodiments, of course, are not to be construed as limiting the breadth of the present invention. Modifications, and other alternative constructions, will be apparent which are within the spirit and scope of the invention as defined in the appended claims.

What is claimed is:

1. A high speed container placement apparatus, comprising:

a plurality of stationary container placement positions disposed about a central axis;

a conveyor movable around said axis;

a plurality of feeder guides and a plurality of discharge guides for guiding and transferring containers between said conveyor and said placement positions;

said feeder and discharge guides being associated and operating in pairs, each pair comprising one of said feeder guides and one of said discharge guides;

means for moving each of said guides around said axis and for causing each of said guides to define an epicycloidal type path around said axis;

means for oscillating said guides about axes parallel to said central axis as each respective guide moves along its epicycloidal type path around said central axis; and each said pair of feeder and discharge guides moving along the same epicycloidal type path with the discharge guide of the pair being disposed ahead of the feeder guide.

2. The apparatus of claim 1, wherein said guides define at least two separate epicycloidal type paths around said axis, at least one said pair of feeder and discharge guides moving along one of the epicycloidal type paths and at least another said pair of feeder and discharge guides moving along another of the epicycloidal type paths.

3. The apparatus of claim 1, wherein said guides define first, second and third separate epicycloidal type paths, and first, second and third pairs of said guides move respectively along said first, second and third paths.

4. The apparatus of claim 1, wherein at least two pairs of said guides are disposed opposite each other on opposite sides of said central axis.

5. The apparatus of claim 4, wherein the feeder guides of said two pairs are connected together and operate simultaneously, and the discharge guides of said two pairs are connected together and operate simultaneously, both said two pairs of guides moving along the same epicycloidal type path.

6. The apparatus of claim 1, wherein there are at least six said pairs of feeder and discharge guides, and wherein:

first, second and third pairs of said six pairs are always disposed on an opposite side of said central axis to fourth, fifth and sixth pairs of said six pairs; and said first and fourth pairs move along a first epicycloidal path, said second and fifth pairs move along a second separate epicycloidal path, and said third and sixth pairs move along a third separate epicycloidal path.

7. The apparatus of claim 1, wherein said oscillating means oscillates all said guides simultaneously in synchronization, all said feeder guides placing containers at placement positions at the same time, and all discharge guides removing containers from placement positions at the same time.

8. A high speed container placement apparatus, comprising:

a plurality of stationary container placement positions disposed about a central axis;

a conveyor movable around said axis;

sequencing means, adjacent said conveyor, for receiving a supply of containers and introducing the containers in sequenced groups onto said conveyor;

exit means, also adjacent said conveyor, for removing containers from said conveyor and exiting the containers from the container placement apparatus;

guiding means for guiding and transferring containers between said conveyor and said placement positions;

said guiding means comprising feeder and discharge guide members for moving the containers respectively to and from the placement positions;

means for moving each of said guide members around said axis and for causing each of said guide members to define an epicycloidal type path around said axis;

means for oscillating said guide members as said guide members move around said axis to transfer said containers between said conveyor and said placement positions; and said sequencing means creating gaps in said sequenced groups to eliminate containers being placed at any placement position adjacent and between said sequencing means and said exit means.

9. The apparatus of claim 8, wherein each said guide member is connected to and moved around said central axis by a moving gear meshing with and moving around a stationary gear having an axis coaxial with said central axis.

10. The apparatus of claim 9, wherein each said guide member is connected to a separate moving gear.

11. The apparatus of claim 10, wherein each said separate moving gear is a spur gear which rolls around the outside of said stationary gear.

12. The apparatus of claim 11, wherein said guide members are disposed eccentrically with respect to said moving gears.

13. The apparatus of claim 12, wherein said guide members extend transversely from support pins which extend upwardly above said moving gears through a gap between said conveyor and a central stationary platform containing said placement positions.

14. The apparatus of claim 13, wherein a central shaft extends coaxially with said central axis, and said support pins are connected to said central shaft by bars.

15. The apparatus of claim 8, wherein each said guide member comprises two parts movable relative to each other, and further comprising means for moving said two parts towards and away from each other for gripping and releasing containers.

16. The apparatus of claim 15, wherein said means for moving said two parts towards and away from each other comprises a cam and a cam follower.

17. The apparatus of claim 16, wherein said cam and cam follower are associated with said oscillating means.

18. A high speed container placement apparatus, comprising:

a stationary platform having a plurality of container placement positions disposed about a central axis;

a conveyor movable around said axis;

a stationary member having gear teeth around a periphery thereof, said periphery surrounding said central axis;

first and second movable gears meshing with said gear teeth;

means for supporting and moving said movable gears and for causing said movable gears to roll around said periphery;

a feeder guide connected to and disposed eccentrically with respect to said first gear;

a discharge guide connected to and disposed eccentrically with respect to said second gear;

said feeder and discharge guides being moved along an epicycloidal type path around said axis as said movable gears roll around said periphery;

said discharge guide removing containers from said placement positions and transferring the removed containers to said conveyor as said discharge guide moves along said epicycloidal path; and said feeder guide transferring containers from said conveyor and placing such containers at rest at said placement positions as said feeder guide moves along said epicycloidal path behind said discharge guide.

19. The apparatus of claim 18, wherein centers of said guides are maintained in alignment with a point on a pitch circle of the respective movable gear.

20. The apparatus of claim 18, wherein said supporting and moving means comprises a spider rotatable about said axis.

21. The apparatus of claim 18, comprising further movable gears meshing with said gear teeth and further feeder and discharge guides associated eccentrically with said further movable gears.

22. The apparatus of claim 18, wherein each of said guides is mounted on a pin which extends upwardly through a gap between said platform and said conveyor, said pin being connected by a crank arm to a shaft eccentrically mounted on a disk, said disk being connected to a respective one of said movable gears for coaxial movement therewith, and said shaft having an axis which passes through a pitch circle of said one movable gear and a center of the respective guide connected thereto.

23. The apparatus of claim 18, wherein a central shaft is disposed coaxial with said central axis, a bar is connected at one end to said central shaft, another end of said bar is rotatably connected to a pin supporting one of said guides, said bar moving around said central axis and maintaining a predetermined spacing of said pin from said central axis.

24. A method of high speed placement of articles, comprising in sequence the steps of:

receiving a continuous supply of articles;

sequencing the articles into groups with predetermined spacing between the sequenced articles;

introducing the sequenced articles into a circular path at a predetermined speed;

transporting said articles along said circular path at said predetermined speed;

decelerating at least two articles at a time along spaced apart epicycloidal paths to place said at least two articles at rest at different stationary rest positions;

maintaining said at least two articles at said rest positions for a predetermined rest period;

accelerating said at least two articles from said rest positions along further different spaced apart epicycloidal paths to transfer said at least two articles back to said circular path;

moving said at least two articles along said circular path at said predetermined speed; and removing said at least two articles from said circular path at said predetermined speed.

25. The method of claim 24, wherein said spaced apart epicycloidal paths and said further different spaced apart epicycloidal paths are all different curved portions of a single epicycloidal path extending around said circular path.

26. The method of claim 24, wherein said spaced apart epicycloidal paths are curved portions of two different epicycloidal paths extending around said circular path, and said further different spaced apart epicycloidal paths are different curved portions of said two different epicycloidal paths.

27. The method of claim 24, wherein there is a series of stationary rest positions spaced apart at equal intervals all the way around but inside said circular path, and said sequencing step spaces said articles for said introducing step to ensure that articles are placed at and removed from a majority of said rest positions in said series but that at least one specific rest position does not receive articles and always remains empty.

* * * * *